United States Patent [19]

Legille et al.

[11] Patent Number: 4,547,116

[45] Date of Patent: Oct. 15, 1985

[54] APPARATUS FOR CONTROLLABLY CHARGING A FURNACE

[75] Inventors: Edouard Legille, Luxembourg; Pierre Mailliet, Howald, both of Luxembourg

[73] Assignee: Paul Wurth, S.A., Luxembourg, Luxembourg

[21] Appl. No.: 675,301

[22] Filed: Nov. 26, 1984

Related U.S. Application Data

[63] Continuation of Ser. No. 288,974, Jul. 31, 1981.

[30] Foreign Application Priority Data

Apr. 3, 1981 [LU] Luxembourg ..... 83280

[51] Int. Cl.[4] ..... F27B 1/20

[52] U.S. Cl. ..... 414/160; 414/299; 414/300; 414/207; 193/16; 266/176; 266/199

[58] Field of Search ..... 414/160, 172, 299, 300, 414/301, 786, 206, 207, 199, 205, 293, 208; 193/16, 17; 266/176, 265, 183, 199

[56] References Cited

U.S. PATENT DOCUMENTS 3,814,403 6/1974 Legille et al. ..... 414/208
4,243,351 1/1981 Legille et al. ..... 414/206
4,273,492 6/1981 Legille et al. ..... 414/160
4,306,827 12/1981 Tsutsumi et al. ..... 414/160

FOREIGN PATENT DOCUMENTS 2725400 12/1978 Fed. Rep. of Germany .
15388 9/1890 United Kingdom .
1442082 7/1976 United Kingdom .

*Primary Examiner*—Bruce H. Stoner, Jr.
*Assistant Examiner*—James E. Barlow
*Attorney, Agent, or Firm*—Fishman & Dionne

[57] ABSTRACT

The position of the discharge end of a tubular member, supported from its first end so as to be rotatable about a first axis and pivotal about a second axis which intersects and is transverse to the first axis, is controlled from a remote location. The controllable tubular member may be the distribution spout of a shaft furnace charging installation which is mounted between the branches of a suspension fork which is rotatable about its own longitudinal axis. A motion transmission mechanism extends through the suspension fork and, in cooperation with the movements of the fork itself, transmits the movements imparted to a control device, which is caused to undergo precisely the same movements as it is desired to have the spout perform, to the spout.

21 Claims, 36 Drawing Figures

Fig. 3a
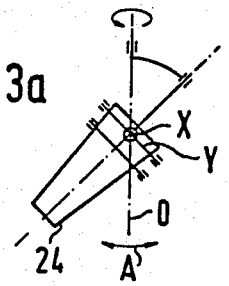
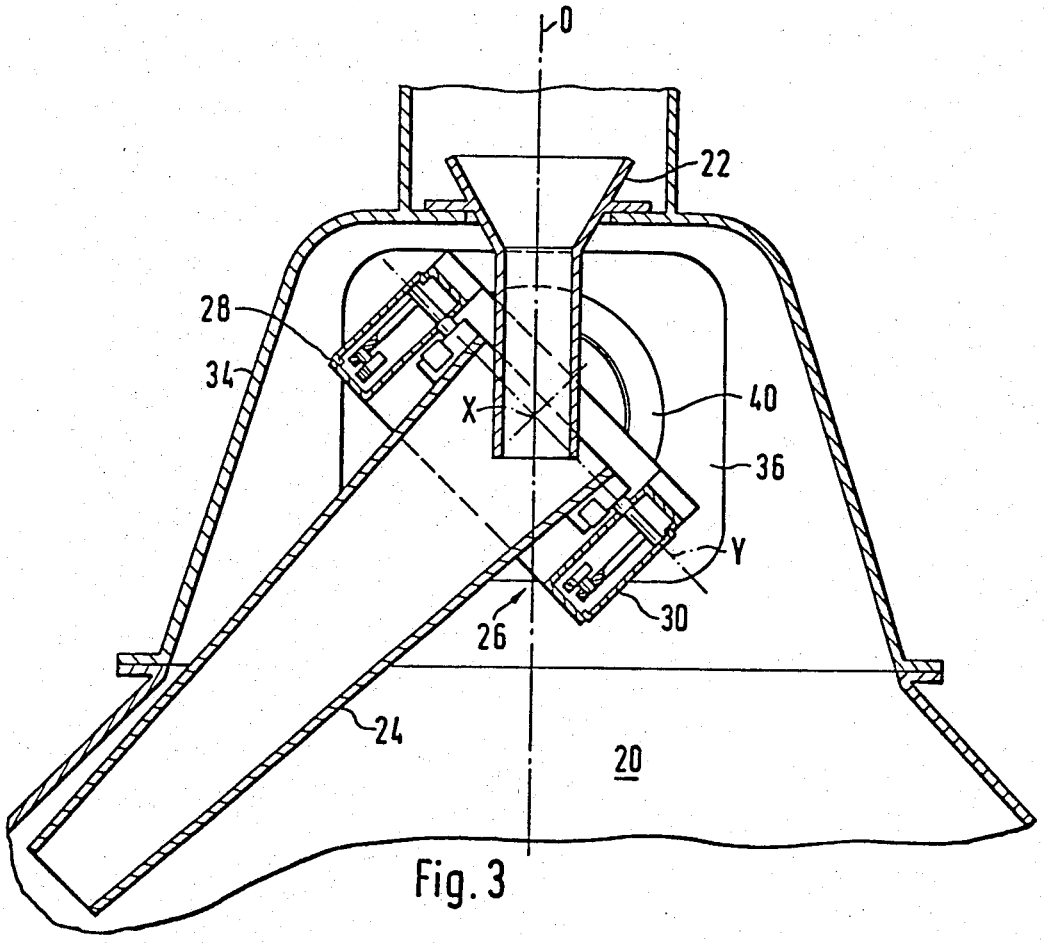
Fig. 3

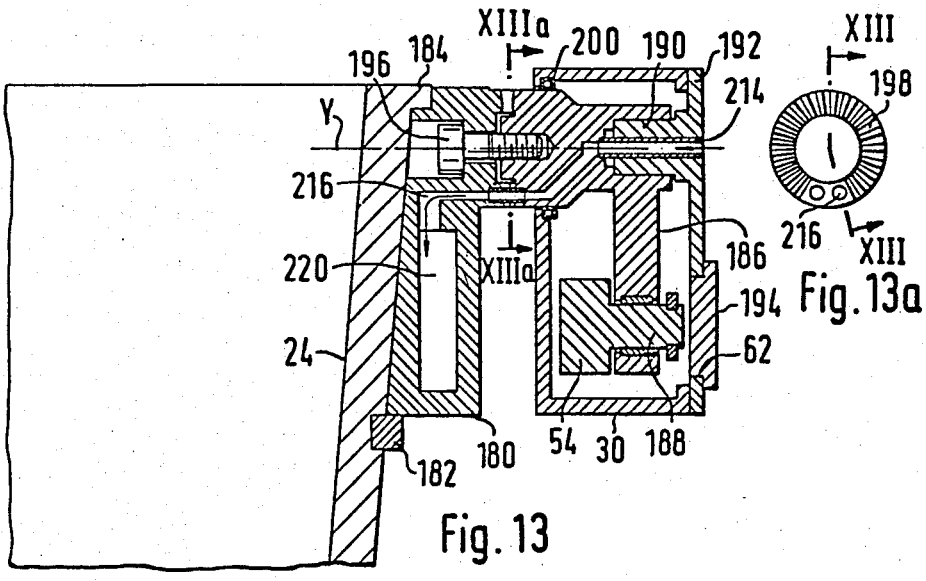
Fig. 13a
Fig. 13
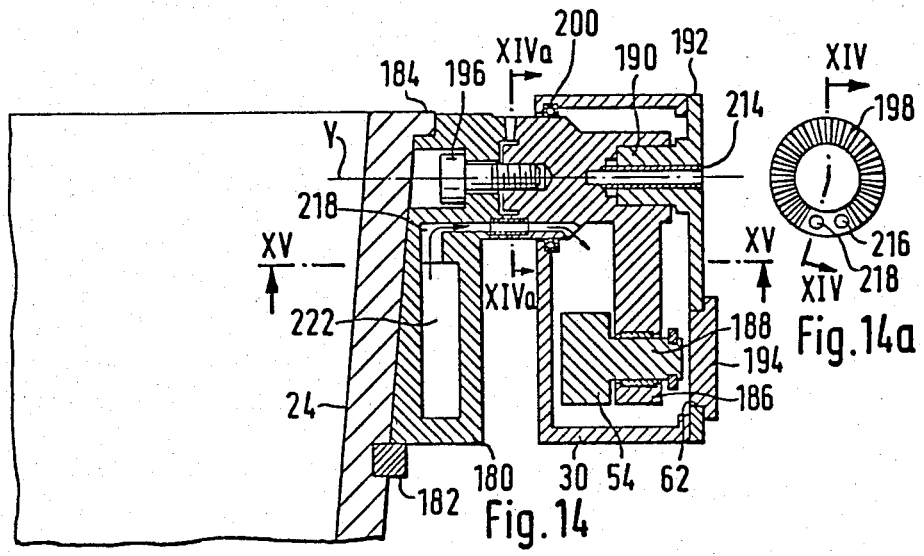
Fig. 14a
Fig. 14
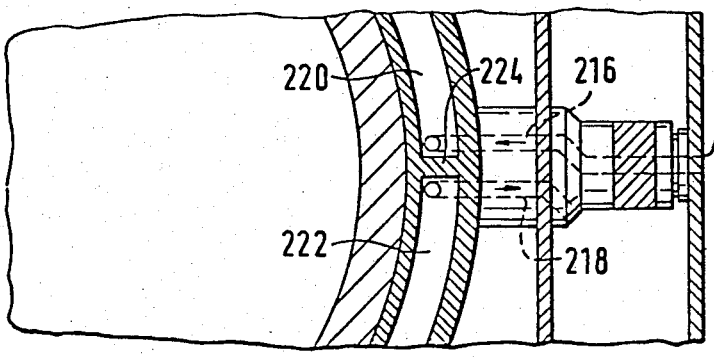
Fig. 15

APPARATUS FOR CONTROLLABLY CHARGING A FURNACE

This application is a continuation of application Ser. No. 288974 filed July 31, 1981.

BACKGROUND OF THE INVENTION (1) Field of the Invention

The present invention relates to the exercise of control over the flow of solid material within a pressurized enclosure and particularly to the actuation of a tubular spout which guides the flow of charge material being deposited on the hearth of a furnace. More specifically, this invention is directed to apparatus for controlling the position, with respect to a pair of transverse axes, of a steerable spout and especially a charge distribution spout supported within the throat region of a shaft furnace. Accordingly, the general objects of the present invention are to provide novel and improved methods and apparatus of such character.

(2) Description of the Prior Art

While not limited thereto in its utility, the present invention is particularly well suited for use in the delivery of granular charge material to the hearth of a blast furnace. It is well known that the "profile" of the material deposited on the furnace hearth is a factor which influences production, particularly in modern furnaces which operate with a high internal pressure. Thus, in recent years considerable attention has been directed to exercising control over the disposition of the furnace charge material, which is delivered from above the furnace and thus flows under the influence of gravity, on the furnace hearth. Presently available devices for exercising control over furnace charge profile include a flow direction control member positioned within the furnace and controlled from the outside of the furnace. These control members receive vertically falling charge material and divert this material in a direction which will produce the desired pattern on the furnace hearth.

At present, charge distribution control mechanisms of the type generally described above are exemplified by the apparatus disclosed in U.S. Pat. No. 3,693,812. Such apparatus, which are rapidly replacing the previously conventionally employed "movable bell" type charging installations, are characterized by a rotatable and angularly adjustable charge distribution chute. These chutes are customarily suspended from the base of a rotary "ferrule" through which the charge material vertically falls. A suitable device is provided for the purpose of varying the angle of inclination of the chute about its point of suspension and independently of its rotation with the ferrule. A characteristic of these "bell-less top" charging installations is that an open chute, typically of semi-cylindrical shape, is utilized for aiming the direction of flow of the charge material and this chute always presents the same surface to the downwardly sliding granular material. Open chutes of the type exemplified by aforementioned U.S. Pat. No. 3,693,812, because of the nature of the directional control exercised thereover, are particularly well suited for movement so as to cause the deposited material to define a spiral or a series of concentric circles. The foregoing is true because the angle of inclination of the open chute can only be varied from the vertical upwardly to an angle which will cause the falling charge material to be deposited adjacent the periphery of the furnace hearth. The two different control actions, i.e., the rotation and inclination angle variation, are relatively easy to coordinate in these prior art installations. Further examples of prior art "bell-less top" charging installations, and control mechanisms for use therein, may be seen from U.S. Pat. Nos. 3,814,403; 3,864,984; 3,880,302; 3,929,240; and 4,071,166.

It has also been proposed to control the direction of flow of charge material falling toward a furnace hearth with a tubular distribution spout which undergoes oscillatory movement. Such oscillatory spouts would be suspended between a pair of mutually perpendicular suspension shafts of the type frequently referred to as a "Cardan suspension". With this type of suspension, the spout could pivot about each suspension shaft and, in order to insure that the charge material distribution achieved with the spout corresponded to the entire charging surface, the spout would have to pass through the vertical position as its angle of inclination was varied. This type of movement, of course, dictates that the charge distribution spout be tubular whereby its entire internal surface is exposed to the moving charge material. Such oscillatory spout type charging installations are disclosed in German patent application No. 2,104,116 and U.S. Pat. No. 4,243,351.

The control mechansims previously proposed for exercising control over the movements of oscillating charge distribution spouts of the type described above would be principally suitable for imparting movement which would cause the discharge end of the spout to undergo a rectangular or serpentine movement. Accordingly, although oscillating spouts offer certain advantages in comparison to the steerable open distribution chutes presently in use, the difficulty in coordinating the two pivotal motions so as to cause the discharge end of the spout to transcribe the desired path, particularly concentric circles or a spiral, has to date resulted in oscillating spout charge distribution systems remaining in the planning state.

To further briefly discuss the theoretical advantages of an oscillatory charge distribution spout when compared to a rotary and angularly adjustable charge distribution chute, oscillating spouts and their associated suspension and control mechanisms offer the potential advantage of ease of dismantling and removal from a furnace for repair. These advantages are described in aforementioned U.S. Pat. No. 4,243,351 another potential advantage resides in the fact that the entire internal surface of the oscillatory spout is exposed to the friction and errosive effects of the charge material and, accordingly, the wear of the spout is more uniform and distributed over a larger area. Thus, the rotary spout can be expected to have a longer service life when compared to the open chute wherein the same surface area is always exposed to the effects of the moving charge material.

Nevertheless, charging installations which employ a rotatable and angularly adjustable open chute have been in use for approximately ten years and have earned the confidence of users. Further, these uses benefit from years of experimentation and improvement of the equipment. These facts, coupled with the previous inability to simply and efficiently exercise control over an oscillatory spout located within a pressurized furnace, from the exterior of the furnace, so as to cause the discharge end of the spout to transcribe concentric circles or a spiral trajectory, these being the charge distribution patterns presently considered to produce optimum furnace operation, have precluded the adoption and use of the rotary spout type charging installation.

SUMMARY OF THE INVENTION

The present invention overcomes the above briefly discussed and other deficiencies and disadvantages of the prior art by providing a novel and improved technique for exercising control over the movements of an oscillating spout from a remote location. The present invention also contemplates control apparatus for use in the practice of this method which enables an oscillatory distribution spout to be moved such that its discharge end will transcribe a circular or a spiral. This novel apparatus is characterized by reliability and moderate expense.

Apparatus in accordance with the present invention is characterized by means for transmitting the motion of an oscillatory control device, which has the same degrees of freedom of movement as the spout but which is located outside of the furnace enclosure, to the spout itself by means of a suitable motion transmission system. More particularly, in accordance with the present invention the control device, and consequently the spout as well, may be actuated in such a manner as to move each of them in accordance with a conical pattern of which the angles at the apex are equal and of which the directors are circles.

An oscillating spout in accordance with the present invention is mounted, typically in a pressurized enclosure, between two branches of a suspension fork. The body of the fork, from which the two branches extend, passes through the side wall of the pressurized enclosure. The spout is mounted so as to be capable of pivoting about its suspension axis between the two branches of the fork and the fork is mounted for rotation about the longitudinal axis of the body thereof. The body of the suspension fork is accommodated and supported in a bearing mounted in the side wall of the enclosure. The above-mentioned control device is mounted on a pivot shaft which, at a point exterior to the pressurized enclosure, is parallel to the suspension axis of the spout. This pivot shaft will tranverse the fork. The body of the fork will be hollow and will serve as a housing for the transmission mechanism which converts the movements of the control device about the axis of the pivot shaft to a corresponding pivoting movement of the spout about its suspension axis.

In accordance with a first embodiment of the present invention the control device comprises an arm having an axis which is parallel to the axis of the spout. The drive mechanism, which imparts movement to the control device, includes a guide bar which defines an arc of a circle, this arc having an angle which is substantially equal to twice the maximum angle of inclination of the spout from the vertical orientation. The radius of curvature of this guide bar is equal to the length of the control device and the center of curvature of the guide bar corresponds to the pivot axis of the control device. The control device drive mechanism further includes a toothed sector gear, slidably mounted on the guide bar and having the same curvature as the guide bar, and a rotary connection between one end of the said sector gear and the control device. The driving mechanism for the control device additionally includes means for rotating the curved guide bar and the sector gear about an axis parallel to the central axis about which the spout is required to move and means for causing the sector gear to slide in the guide bar to thereby alter the angle of inclination of the control device relative to the axis about which the guide bar rotates.

Continuing to discuss the first embodiment, the body of the suspension fork is hollow and the motion transmission mechanism, which couples the movements of the control device to the spout, consists of a connecting rod which is coupled at one end to the pivot shaft of the control device. This connecting rod, which may take the form of a two-pronged fork, is movable in the direction of the longitudinal axis of the suspension fork and is connected at its second end to a pair of arms integral with the spout or with the spout suspension shaft. The length of the connecting arm is such that the longitudinal axis of the spout will be parallel to the lever which connects the end of the connecting rod to the control device pivot shaft.

In accordance with a further embodiment of the present invention, the means for transmitting the motion of the control device to the spout may consist of a rotary shaft which is provided at each of its ends with segmented conical pinions. At a first end of the transmission shaft the pinion is driven by a gear affixed to the pivot shaft of the control device. The pinion at the second end of the transmission shaft engages a gear which is directly or indirectly coupled to the suspension shaft of the spout.

In accordance with still another embodiment of the invention, the control device may itself comprise a gear sector which is pivotal about an axis corresponding to the longitudinal axis of the fork. This gear sector is supported by brackets capable of rotating about an axis which is parallel to the axis about which the spout is required to move. The control device in this embodiment further comprises a rod having its longitudinal axis parallel to the longitudinal axis of the spout. This rod is coupled, by means of a rotary connection, to a base member which forms a part of the pivot shaft about which the control device rotates. In this embodiment the drive mechanism for the control device will comprise first means for causing the brackets to rotate about their pivot axis and second means, which may be operated independently of the first means, for altering the angle of inclination of the rod relative to the rotation axis of the bracket.

In the embodiment described immediately above, the suspension fork for the spout is of hollow construction and takes the form of a double fork having a first pair of branches between which the spout is mounted and two oppositely disposed branches between which the control device is mounted.

In various embodiments of the present invention the guide bar or other rotatable means, the brackets in the embodiment described immediately above for example, may be mounted at the end of a first hollow rotatable control shaft which is driven by a first motor, while a second rotatable control shaft, positioned coaxially with the first control shaft and capable of turning independently of the first shaft, will be driven by a second motor through appropriate gearing. The second motor may be mounted on a frame affixed to the hollow rotatable shaft driven by the first motor.

In a further embodiment of the present invention, the guide bar or brackets form part of a rotary cage or plate provided with an integral external drive rim or gear. This external drive rim will be driven by a first motor whereby the cage or plate will rotate together with the guide bar and gear sector about an axis parallel to the central axis about which the spout is required to move.

A second motor, operable independently of the first motor, acts via a reduction gear system on a pinion which cooperates with the gear sector to form a rack and pinion which alters the angle of inclination of the control device relative to the axis about which it rotates.

In the embodiment described immediately above, the motor which produces the changes in the angle of inclination of the control device may be mounted on the cage or plate at a point displaced from its rotation axis and the second motor will thus move about this axis. However, it is within the contemplation of the invention to mount the second motor coaxially with the axis of rotation of the cage or plate and to employ a selectively operable clutch mechanism for coupling the rotor of this second motor to the cage or plate.

The present invention thus relates to an installation particularly well suited for use in the charging of a shaft furnace and comprising a vertical feed channel mounted in the head of the furnace for guiding material released from an external storage device or devices to the interior of the furnace. An installation in accordance with the present invention further includes an oscillating charge distribution spout positioned immediately "downstream" from the feed channel and a suspension and control device, as generally described above, for aiming the spout.

The entire suspension and control apparatus for the spout, including the driving mechanism for the control device and the bearing which supports the suspension fork for the spout, is mounted in a frame removably attached to the furnace. Accordingly, the entire charge distribution control apparatus, including the oscillating spout, may be easily and rapidly removed for servicing.

The suspension fork for the oscillating spout which is controlled by the apparatus of the present invention may be positioned such that its longitudinal axis intersects and is transverse to the axis, for example the vertical axis of a furnace, about which the spout moves. Alternatively, the longitudinal axis of the suspension fork may be inclined at an angle with respect to the axis about which the discharge end of the spout moves.

In a furnace charging installation in accordance with the present invention the vertical feed channel may partly or wholly be pivotally mounted so as to permit movement thereof to a position where it will not interfere with disassembly of that portion of the charging installation comprising the spout and its suspension fork.

In accordance with the preferred embodiment of the present invention, the suspension fork of the spout is in the form of a sealed enclosure within which the motion transmission device, which couples the control device to the spout, operates. A coolant may be circulated through the suspension fork. If deemed necessary or desirable, the pressure of this coolant will be equalized to the pressure within the furnace to eliminate pressure differentials across the joints and seals of the system.

BRIEF DESCRIPTION OF THE DRAWING

The present invention may be better understood and its numerous objects and advantages will become apparent to those skilled in the art by reference to the accompanying drawing wherein like reference numerals refer to like elements in the several FIGURES and in which:

FIG. 3 is a schematic front elevation view of the apparatus of FIG. 1 with the distribution spout aimed in a direction offset 90° from the directions of FIGS. 1 and 2;

FIG. 3*a* is a diagrammatic showing relative to the schematic showing of FIG. 3;

FIG. 13 is a schematic cross-sectional side elevation view of a distribution spout suspension mechanism in accordance with the present invention;

FIG. 13*a* is a cross-sectional view, taken along line a—a, of the apparatus of FIG. 13, the view in FIG. 13 being indicated by section line XIII—XIII in FIG. 13*a;*

FIG. 14 is a view, similar to FIG. 13, taken along line XIV—XIV of FIG. 14*a;*

FIG. 14*a* is a cross-sectional view taken along line a—a of FIG. 14;

FIG. 15 is a cross-sectional view of the spout suspension of FIGS. 13 and 14, FIG. 15 being taken along line XV—XV of FIG. 14;

DESCRIPTION OF THE PREFERRED EMBODIMENTS

Figures 1, 1A:
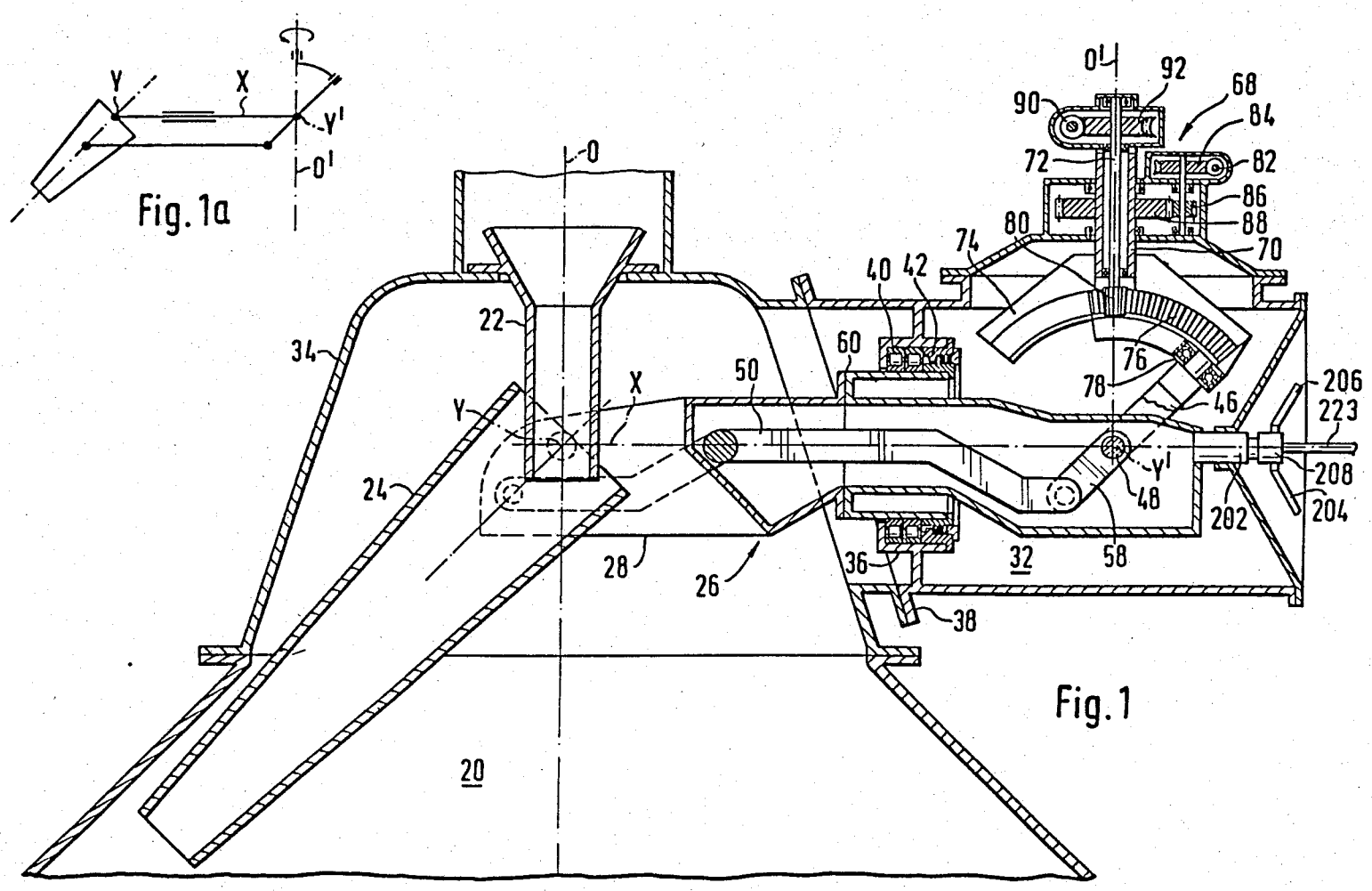
FIG. 1 is a schematic side elevation view of apparatus in accordance with a first embodiment of the present invention.
FIG. 1*a* comprises a diagrammatic showing of the operation of the apparatus of FIG. 1.

While several embodiments of the present invention will now be described in the environment of a blast furnace, it is to be noted that the present invention may also be employed in charging systems for other types of furnaces or enclosures and particularly for use in the controlled delivery of material to an enclosure wherein a high pressure and/or high temperature are maintained during operation.

A first embodiment of the present invention is depicted in FIGS. 1–4 and 7–10 and in the following description reference should be had simultaneously to these FIGURES. In FIGS. 1–4 the head or top portion of a blast furnace is indicated generally at 20. The material with which the furnace is to be charge is supplied, via a vertical feed channel 22 which is coaxial with the furnace axis O, from an upper chamber or storage hopper which is not shown in the drawing. The charge material which passes downwardly through channel 22 is distributed on the furnace hearth, in accordance with a desired pattern to produce the appropriate charge profile on the hearth, through the use of an oscillating spout 24. Spout 24, which preferably has the shape of a truncated cone, is pivotally suspended between the two branches 28 and 30 of a fork-shaped suspension system, indicated generally at 26, which extends through the wall of the furnace. The spout may thus pivot about the axis Y defined by its suspension from fork 26. The axis Y of the spout suspension intersects the vertical axis O of the furnace. In the manner to be described below, the fork 26 is capable of pivoting about its longitudinal axis X and this longitudinal axis intersects, and is transverse to, the axes Y and O.

The fork 26 is mounted in a wall 36 which separates the interior of a control housing 32 from the interior of the furnace head 20. The housing 32 is removably mounted, by means of cooperating flanges 38, from an extension 34 of furnace head 20. The extension 34 of furnace head 20, known in the art as a carcass, is welded to the exterior of the furnace.

The fork 26 includes, in addition to the branches 28 and 30, a tubular body portion 44. This body portion 44 of fork 26 is supported in wall 36 by means of a bearing system 40 which may, for example, consist of a pair of conical roller bearings. In order to prevent leakage of the dirt-laden blast furnace gases into control housing 32, a conventional stuffing box 42 is provided adjacent the bearing system 40. It is to be noted that other means are available to insure a hermetic seal between the furnace interior and the control housing interior and, additionally, the interior of control housing 32 may be pressurized to a pressure equal to or higher than the pressure prevailing within the furnace whereby the pressure differential which would otherwise exist across wall 36 may be eliminated.

The control mechanism located within housing 32 includes a control device 46 which is mounted on a rotatable shaft 48. The shaft 48, which traverses the body 44 of fork 26, is positioned such that its axis Y′ is parallel to the axis Y of the suspension of spout 24 from fork 26. The control device 46, accordingly, has the same degree of freedom as spout 24, particularly the ability to pivot about the axis Y′ and to pivot together with the fork 26 about the longitudinal axis X of the fork. Thus, in accordance with the present invention, the movements which spout 24 are required to perform may also be imparted to the control device 46. A motion transmission mechanism is, of course, required for the purpose of enabling the pivoting movement of control device 46 about its axis Y′ to be delivered to and reproduced by spout 24. The transmission of the pivoting motion in the perpendicular direction to axes Y and Y′, i.e., the rotation about axis X, is transmitted directly to spout 24 by fork 26 which, as noted above, is rotatable and connected to spout 24 by the spout suspension.

Figure 9:
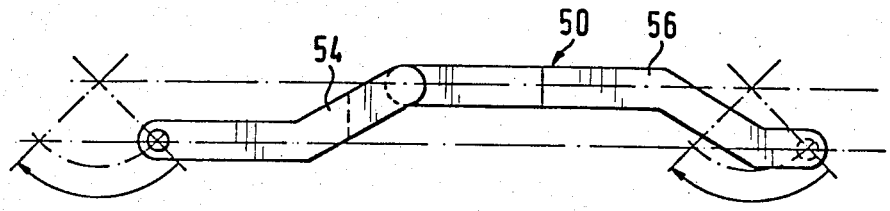
FIG. 9 is a side view of the connecting rod of the motion transmission mechanism in accordance with one embodiment of the present invention.
Figure 10:
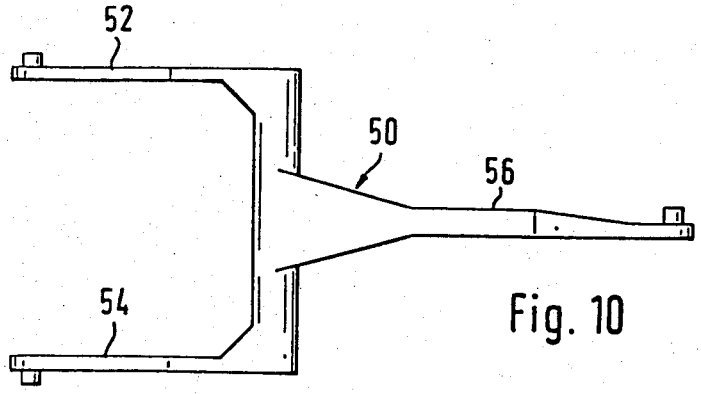
FIG. 10 is a plan view of the connecting rod of FIG. 9.

The first embodiment of a motion transmission mechanism suitable for positioning within the suspension fork 26 is shown in FIGS. 9 and 10. This transmission mechanism or connecting rod, indicated generally at 50, is also in the form of a two pronged fork comprising a rod 56 and a pair of parallel branches 52 and 54. The rod 56 will, of course, be positioned within the body 44 of fork 26 whereas the branches 52 and 54 will be respectively situated within the branches 28 and 30 of fork 26. The ends of the branches 52 and 54 are connected to spout 24, or to its aligned and oppositely disposed pivot shafts, in the manner which will be described in greater detail below. The free end of rod 56 is coupled to the pivot shaft 48 for control device 46 by means of a lever 58 (FIGS. 1 and 2), the lever 58 thus effectively acting as a prolongation of the control device 46. In actual practice, in the interest of insuring that the lever 58 has adequate mechanical strength, this component will typically be in the form of a double lever with the free end of rod 56 being articulated between the arms comprising this double lever. Alternatively, the lever 58 may be a unitary structure and the end of rod 56 which is connected to the lever may be constructed as a fork which is articulated to this lever.

Figure 7:
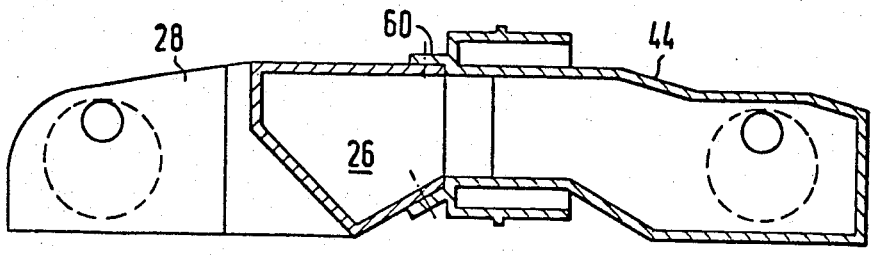
FIG. 7 is a side view of a suspension fork for an oscillatory charge distribution spout in accordance with one embodiment of the present invention.
Figure 8:
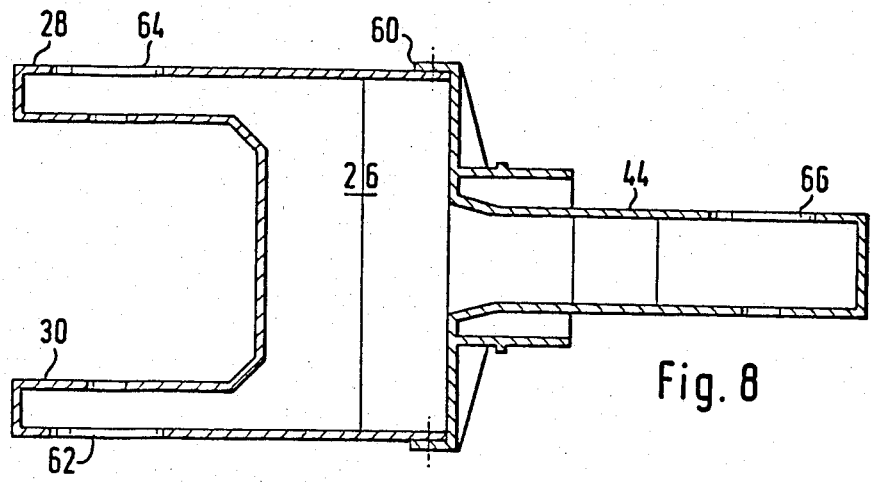
FIG. 8 is a top plan view of the fork of FIG. 7.

The connecting rod 50 is preferably a rigid unitary element formed either as a single casting or separate elements which have been joined by welding. In order to permit installation of the rod 50 and lever 58 within the spout suspension fork 26, the fork 26 must be capable of disassembly. Referring to FIGS. 7 and 8, it may be seen that the tubular body 44 of fork 26 is removably connected, as indicated at 60, to the member which defines the branches 28 and 30. FIGS. 7 and 8 also show that branches 28 and 30 of fork 26 are provided with respective apertures 64 and 62 which enable the establishment of a connection between the arms 52 and 54 of connecting rod 50 and the pivot shafts of spout 24. A further aperture 66 is provided in the body portion 44 of fork 26 to permit installation of the pivot shaft 48 and the lever 58.

The operation of the apparatus of FIGS. 1–4 and 7–10 will now be described. If the control device 46 is caused to pivot about the axis Y′ of shaft 48, lever 58 will undergo a corresponding pivotal motion and will thus transmit a kind of pendular movement to the connecting rod 50. The movement of rod 50 will cause spout 24 to pivot about its suspension axis Y by an angle exactly equal to that through which the control device 46 has moved about axis Y′. Consequently, if device 46 pivots from the position shown in FIG. 1 to the position shown in FIG. 2 the spout 24 will likewise pivot between the positions illustrated in FIGS. 1 and 2 respectively. During this period, i.e., during the motion of spout 24 from the FIG. 1 position to the FIG. 2 position, the connecting rod 50 will move between its two extreme positions as indicated by the arrows on FIG. 9. These two extreme positions are likewise illustrated in FIGS. 1*a* and 2*a* in which the transmission mechanism, i.e., the connecting rod 50 and lever 58, are represented schematically by a parallelogram which symbolizes the parallelism between the axes of spout 24 and control device 46. If control device 46 is caused to pivot so that any point thereon moves in a plane perpendicular to the plane defined by the above-discussed parallelogram, i.e., if the angle between the longitudinal axis of control device 46 and the vertical is kept constant and device 46 pivots in a plane perpendicular to the plane of the drawing (a plane defined by the axis Y′ and the longitudinal axis of control device 46), the fork 26 will rotate about its longitudinal axis X. This will result in spout 24 being tilted in the plane of FIG. 3 by an amount corresponding to the amplitude of the pivoting movement imparted to control device 46. This pivoting movement is represented by the arrow A in FIG. 3*a*.

It is believed clear from the preceding description that the spout 24, or more precisely the axis of spout 24, exactly follows the movements of control device 46 during both the pivoting movement about axis Y′ and the pivoting movement about axis X. Consequently, the axis of spout 24 always remains parallel to the axis of control device 46. Thus, if the end of the control device 46 is displaced over a circular trajectory, i.e., if the end of device 46 moves over a conical surface the apex of which is situated on the axis Y′, the spout 24 will effect the same movement about the vertical axis 0 of the furnace and the lower end of the spout will transcribe a circle. This movement is illustrated schematically by the arrows on FIGS. 1*a* and 2*a*.

Figure 2:
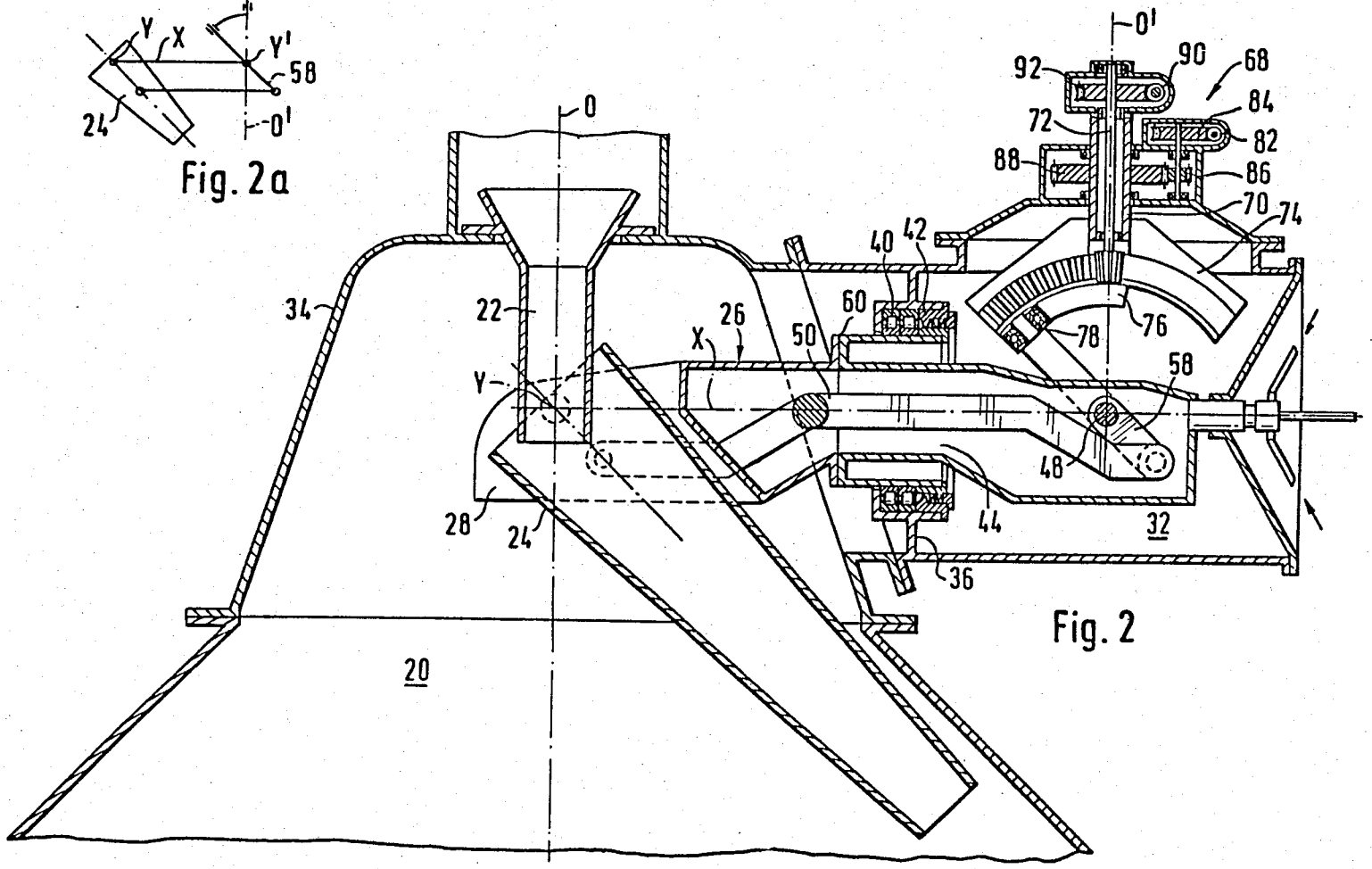
FIG. 2 is a view similar to that of FIG. 1 showing the distribution spout aimed in a direction opposite to that shown in FIG. 1.
Figure 2A:
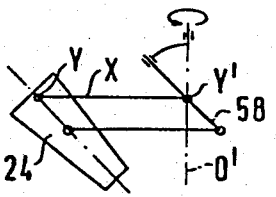
FIG. 2*a* is a diagrammatic showing, similar to FIG. 1*a*, depicting the apparatus of FIG. 1 in the position of FIG. 2.
Figure 4:
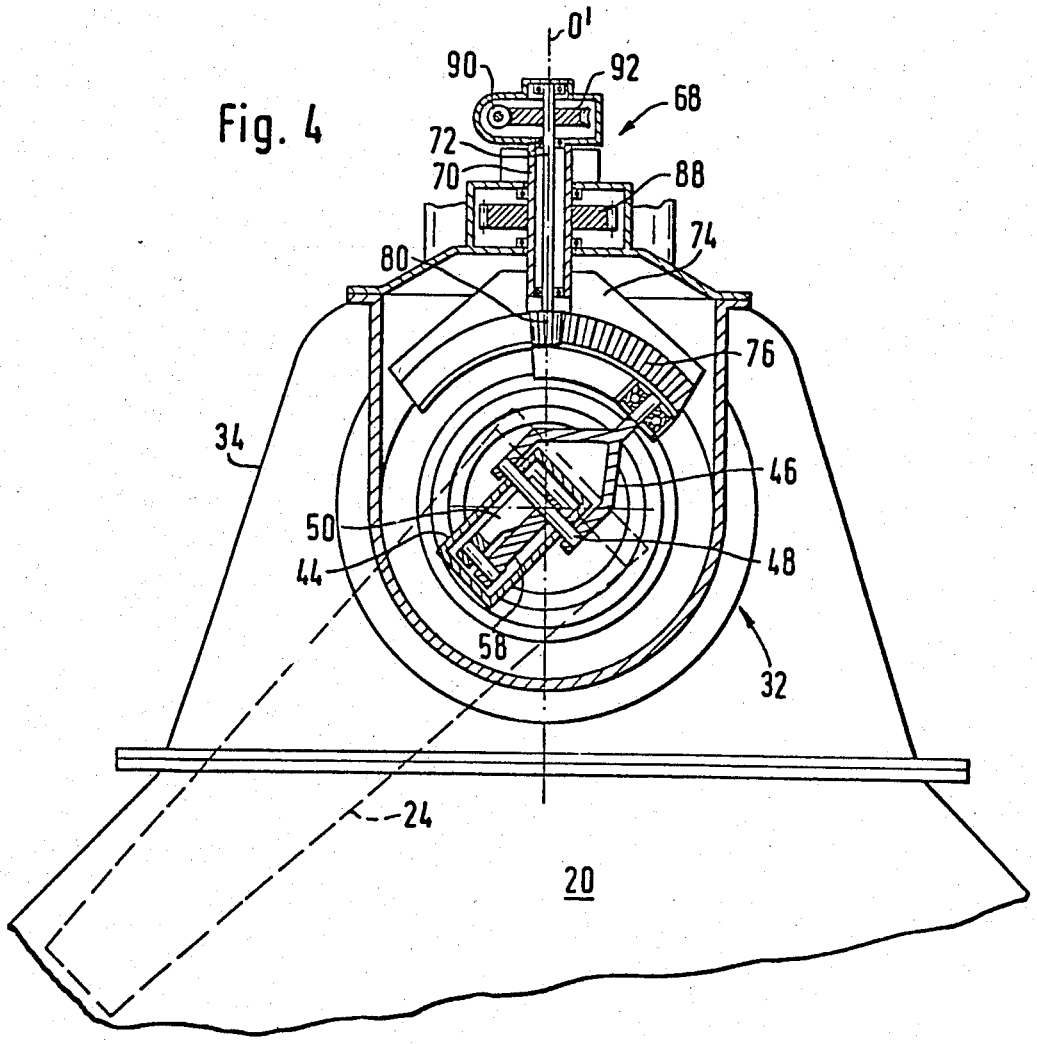
FIG. 4 is a schematic vertical section through the control mechanism of the apparatus of FIGS. 1–3 with the distribution spout in the position of FIG. 3.

The spout suspension and control system of the present invention enables the charge material to be delivered to the furnace hearth in accordance with concentric circles or over a spiral trajectory. In order to accomplish the foregoing, a suitable driving mechanism is provided to displace the end of the control device 46 in accordance with the desired pattern, i.e., concentric circles or a spiral. FIGS. 1, 2 and 4 schematically illustrate a first embodiment of such a drive mechanism for control device 46. This drive mechanism comprises a motor unit, indicated generally at 68, which is preferably movably mounted on the exterior of housing 32. A pair of coaxial control shafts 70 and 72 extend through bearings, and also appropriate rotary seals if necessary, from the motor unit 68 to the interior of housing 32. One of these control shafts, the outer shaft 70 in the disclosed embodiment, has a guide bar 74 mounted on the end thereof which extends into housing 32. Guide bar 74 is curved so as to define a circular arc having an angle which is substantially equal to twice the maximum angle of inclination of spout 24 relative to the vertical axis 0 of the furnace. Guide bar 74 is arranged so that its radius of curvature will be equal to the length of control device 46. The longitudinal axis of the coaxial control shafts 70 and 72 passes through the center of curvature of guide bar 74 and this center of curvature must be situated on the pivot axis Y′ of control device 46, i.e., the axis of shaft 48.

A gear sector 76, having the same radius of curvature as guide bar 74 and a length slightly greater than half that of the guide bar, is slidably mounted on the lower concave surface of guide bar 74. A rotary connection 78 is provided between the end of control device 46 and the opposite ends of gear sector 76. The rotary connection 78 may be provided simply by means of a bearing system mounted on the gear sector 76, or on the control device 46, and a journal provided on the other of these two elements and engaging the bearing system. The gear sector 76 is engaged by a pinion 80 affixed to the end of the inner control shaft 72 thereby establishing a rack and pinion drive for the end of control device 46.

The motor unit 68 includes means for actuating the control shafts 70 and 72 independently of one another. A first endless screw 82, actuated by a motor which has not been shown in the drawing, drives the outer control shaft 70 through a reduction gear system consisting of a worm wheel 84 and pinions 86 and 88. A second drive device, which includes a second motor which similarly has not been shown in the drawing, is mounted on shaft 70 and drives the inner control shaft 72 via an endless screw 90 and a worm wheel 92. Since the second drive device rotates with control shaft 70, power to the drive motor of this second device is supplied via friction contacts in the manner well known in the art.

Assuming that only the motor actuating the endless screw 82 is energized, the control shafts 70 and 72 and also the worm gear 92 and the endless screw 90 will rotate together at the speed determined by the motor. Accordingly, the guide bar 74 and the gear sector 76 will rotate about the longitudinal axis 0′ of the control shafts 70 and 72. The end of the control device 46, as a consequence of the rotary connection 78, will thus be driven and will move in a circular path which defines a portion of a conical surface. Assuming that the position of the various elements shown in FIG. 1 is the starting point, FIG. 2 depicts the position occupied by control device 46 after a rotation through an angle of 180°. The axis of the spout 24 will, of course, also have performed a movement which corresponds to the movement of the control device 46. If only the motor which drives endless screw 90 is energized, the guide bar 74 will remain stationary while the pinion 80 will cause the gear sector 76 to slide on the guide bar. The movement of the gear sector 76 will result in a change in the angle of inclination of the control device 46 and, consequently, a change in the angle of inclination of spout 24 relative to the furnace vertical axis 0. Thus, in order to cause the discharge end of spout 24 to transcribe concentric circles, the first motor is actuated in order to rotate the slide bar 74 and, after each complete rotation of slide bar 74, the second motor is actuated in order to change the angle of inclination of the control device 46.

As may be seen from FIGS. 1 and 2, the entire suspension and control apparatus, along with the distribution spout 24, can be dismantled as a single unit simply by releasing the bolts at the flanges 38 and withdrawing the entire apparatus through the side aperture in the carcass 34. The foregoing will be accomplished by moving the spout to the position shown in FIG. 2 and then releasing or removing the vertical feed channel 22. The spout is then tilted into the position shown in FIG. 1 and can thereafter easily be extracted without disconnecting the spout from its suspension system. This diassembly procedure will be described in greater detail below.

Figures 5, 5A:
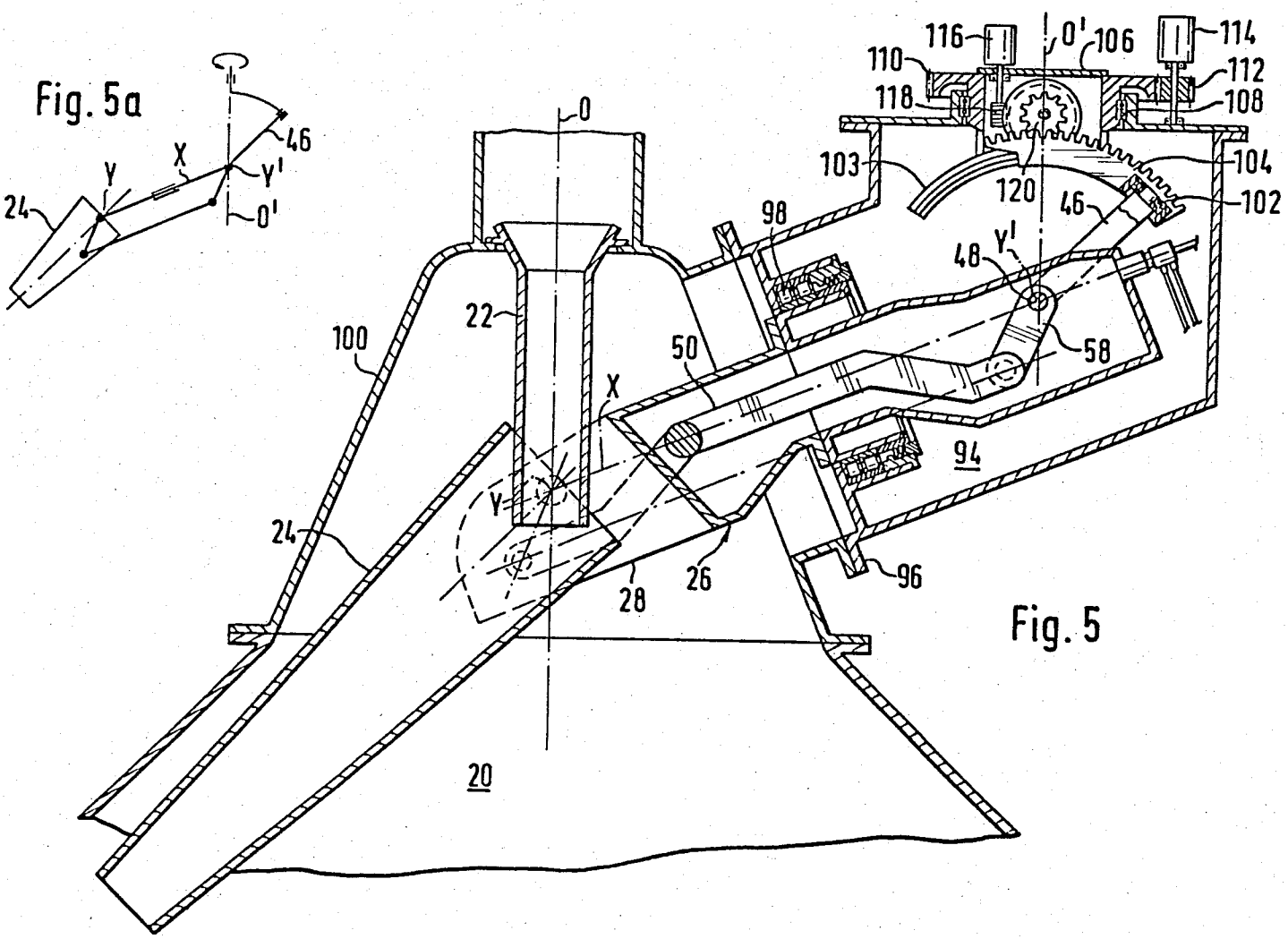
FIG. 5 is a cross-sectional schematic side elevation view of apparatus in accordance with a second embodiment of the present invention.
FIG. 5*a* is a diagrammatic showing representing the operation of the apparatus of FIG. 5.
Figure 6:
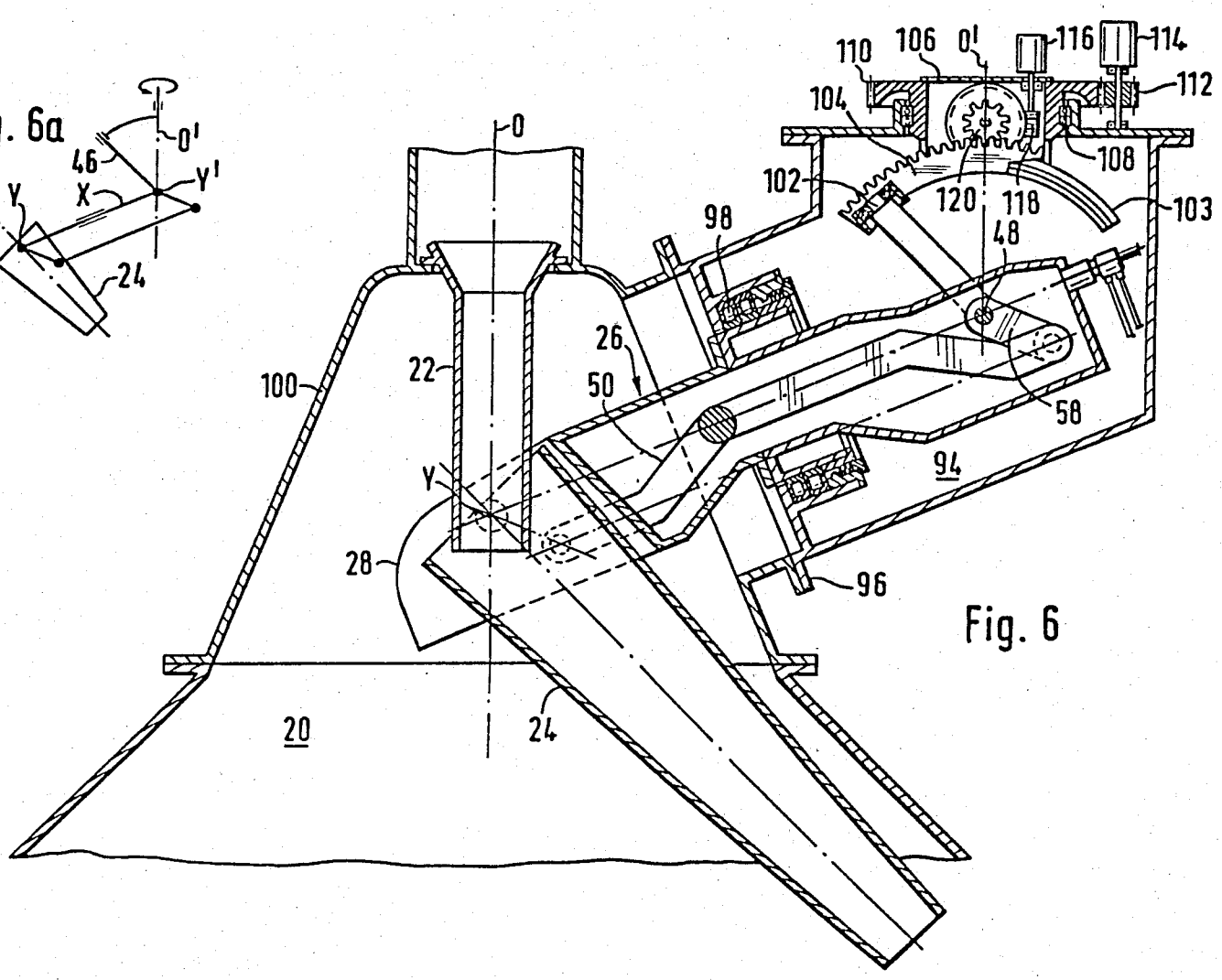
FIG. 6 is a view similar to FIG. 5 with the distribution spout shown in a second position.

A second embodiment of an oscillatory spout control mechanism in accordance with the present invention is shown in FIGS. 5 and 6. In the embodiment of FIGS. 5 and 6 the same suspension elements are employed as described above in the discussion of FIGS. 1–4 and 7–10. These suspension elements include the fork 26 and the connecting rod 50. However, in the embodiment of FIGS. 5 and 6, the axis of fork 26 is inclined with respect to the horizontal and thus the axis X of rotation of fork 26 is not transverse to the vertical axis 0 of the furnace as in the above-described embodiment. The arrangement of FIGS. 5 and 6 thus requires that the housing 94 for the control device be modified so as to be inclined such that it may accept the fork 26. Similarly, the securing flange system 96 for housing 94 and the bearing system 98 for fork 26 lie in planes which are inclined with respect to the vertical. In FIGS. 5 and 6 the carcass, which defines an extension of the furnace head 20, is indicated at 100. The arrangement of FIGS. 5 and 6 has the attribute of rendering the disassembly and removal of spout 24 from the furnace an easier procedure than is the case with the embodiment of FIGS. 1–4. Thus, with the spout in the position shown in FIG. 5 the axis of the spout is only slightly misaligned with respect to the axis of the aperture in the side of the carcass 100 through which the spout will be removed for servicing.

Figure 6A:
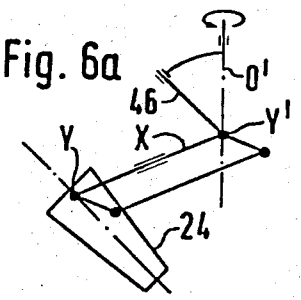
FIG. 6*a* is a view similar to FIG. 5*a* but showing the distribution spout in the position of FIG. 6.

Although the various components of the furnace charging system of the embodiment of FIGS. 5 and 6 are arranged in a somewhat different manner when compared to the embodiment of FIGS. 1–4, the operational method remains the same. Thus, as may be seen from FIGS. 5*a* and 6*a*, the parallelism between the axis of spout 24 and the control device 46 is maintained and both the axis of the spout and the control device will process about a vertical axis. By way of distinction, however, in the embodiment of FIGS. 5 and 6 the prolongation of the axis of lever 58 is not parallel with the axis of the control device 46. Also, in the embodiment of FIGS. 5 and 6 the point of connection of the end of connecting rod 50 of the motion transmission mechanism to the spout 24 does not define an axis which intersects the axis of the spout although the line between this connection point and the axis Y defined by the spout suspension from fork 26 remains parallel to the axis of lever 58. The differences in the arrangement of lever 58 and the point at which the transmission mechanism 50 acts on spout 24 results in a reduction of the total length of the suspension fork 26. FIGS. 5 and 6 also show a modified drive mechanism for imparting the movements which spout 24 are required to perform to the control device 46. It is, however, to be noted that the driving mechanism of FIGS. 5 and 6 is not limited to use in an embodiment where the axis of fork 26 is inclined at an angle and, accordingly, the driving mechanism of FIGS. 5 and 6 could equally well be employed with the embodiment of FIGS. 1–4 and vice versa.

Continuing to refer to FIGS. 5 and 6, as in the case of the previously described embodiment, the control device 46 is coupled by means of a rotary connection to a sector gear 104 which slides on a guide bar 103. The guide bar 103 is integral with a rotary cage 106 which is supported, by means of bearings 108, in a side wall of the housing 94. Rotary cage 106 is provided with an external drive gear 110 which is engaged by a pinion 112 driven by a first electric motor 114. Energization of motor 114 will cause the combination of rotary cage 106, guide bar 103 and sector 104 to rotate about vertical axis 0' whereby control device 46 will also rotate about this same vertical axis. The rotation of control device 46 about a vertical axis will cause spout 24 to be driven so that its axis will move about furnace axis 0 and in so doing will define a conical surface with a constant angle of inclination.

A second electric motor 116 is provided for the purpose of changing the angle of inclination of control device 46 and thus of spout 24. Motor 116 is mounted on cage 106 for movement therewith about axis 0'. Motor 116 drives sector gear 104 via a gear drive which includes a worm gear 118 and a pinion 120. Since motor 116 moves, it is necessary that it be supplied with electrical power via friction contacts in the manner known in the art.

Figures 11, 11A:
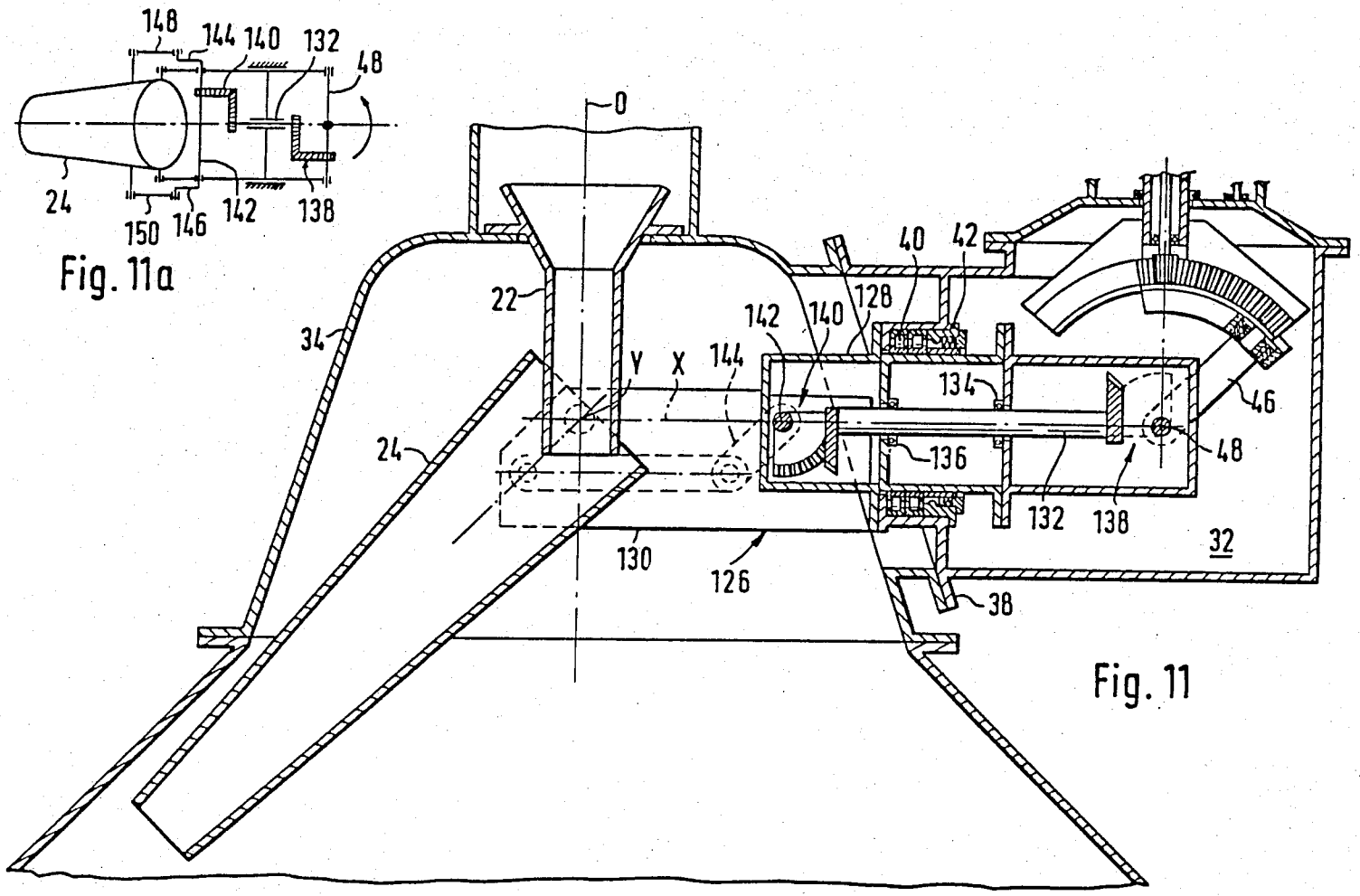
FIG. 11 is a schematic sectional side elevation view of apparatus in accordance with a third embodiment of the present invention.
FIG. 11*a* is a diagrammatic illustration of the operation of the apparatus of FIG. 11.

A further embodiment of the present invention is depicted in FIGS. 11 and 11*a*. The embodiment of FIG. 11 differs from the previously described embodiments by virture of modifications in both the suspension system for the spout 24 and the drive mechanism for controlling the movements of the spout. However, as in the above described embodiments, the spout suspension and drive mechanism includes a suspension fork, indicated generally at 126, which includes a substantially horizontal cylindrical body portion 128 supported in the wall which separates the interior of the furnace from the interior of the housing 32 by means of a bearing system 40. The fork 126 also includes two spout suspension arms or branches, only one of which may be seen at 130.

The motion transmission mechanism for coupling control device 46 to spout 24 comprises, in the embodiment of FIG. 11, a rotary shaft 132 supported in a pair of bearings 134 and 136 within the body portion 128 of fork 126. As in the embodiment of FIGS. 1–4, the tilting of control shaft 48 is transmitted to spout 24 by means of rotation of fork 126 in bearings 40. Rotation of shaft 48 about its axis is transformed into a rotation of shaft 132 about axis X of fork 126 by means of a gear drive indicated generally at 138. Rotation of shaft 132 is converted back into a pivoting movement at a point inside of the furnace head by means of a second gear drive indicated generally at 140. The gear drive 140 imparts rotation to a shaft 142 which is parallel to shaft 48. The manner in which the rotation of shaft 48 is converted into rotation of shaft 142 may be clearly seen from the diagrammatic illustration comprising FIG. 11*a*.

The rotation of shaft 142 is converted, by means of a parallelogram linkage comprising arms 144 and 146 and connecting rods 148 and 150, into pivotal movement of spout 24 about its suspension axis Y. The means by which this is accomplished is also clearly illustrated in FIG. 11*a*.

In the embodiment of FIG. 11, the axis of spout 24 and that of control device 46 remain parallel with one another at all times. Accordingly, the desired movements may be imparted to the control device 46 by any of the above-described drive mechanisms in order to cause the end of the control device 46 to move in concentric circles or a spiral path whereupon furnace charge material descending through spout 24 will be distributed in either concentric circles or a spiral trajectory. For purposes of illustration, a drive system for the control device 46 similar to that discussed above in the description of FIGS. 1 and 2 has been shown in FIG. 11.

Figure 12:
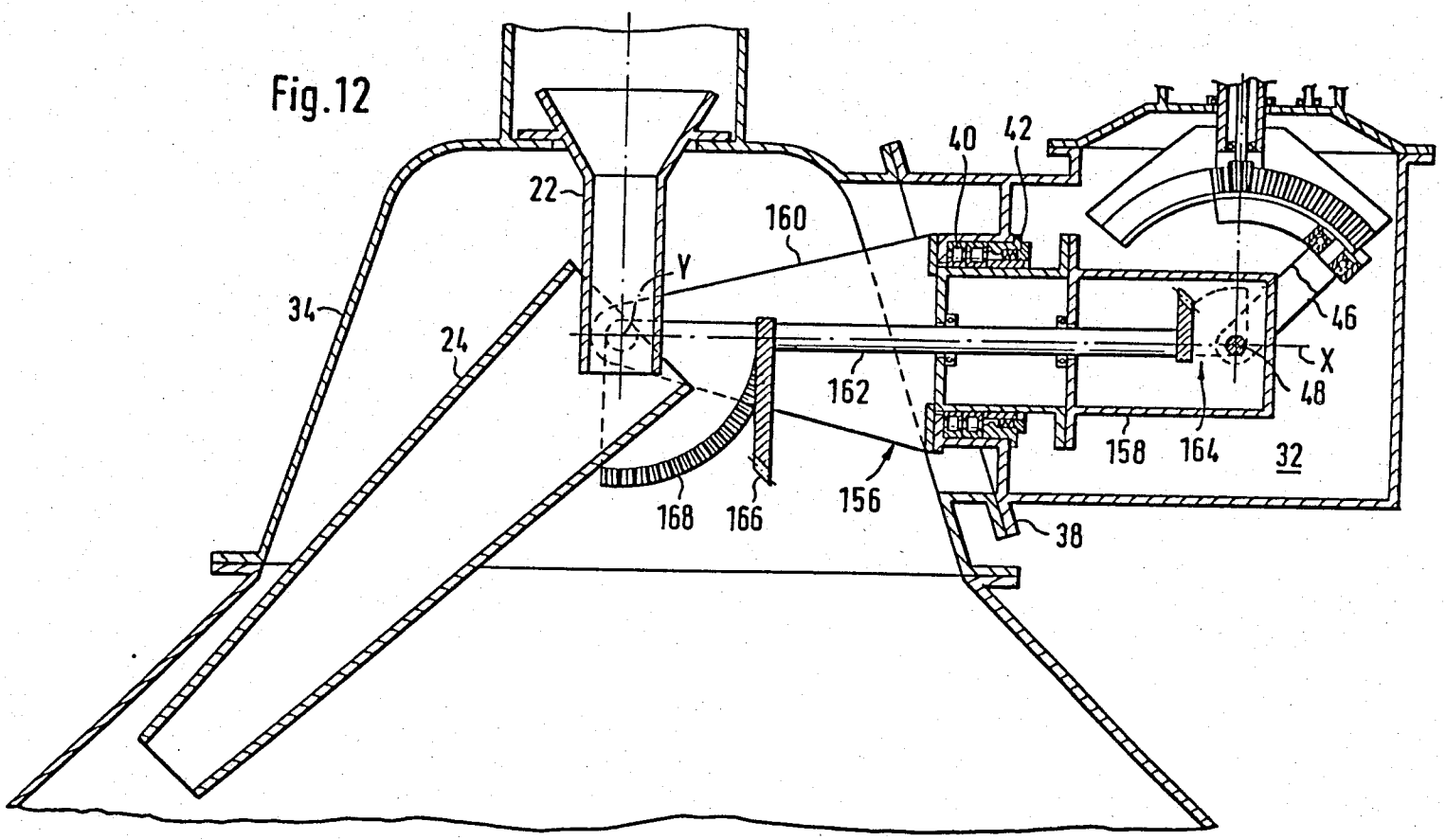
FIG. 12 is a schematic sectional side elevation view of a fourth embodiment of the present invention, the embodiment of FIG. 12 comprising a modification of the embodiment of FIG. 11.

FIG. 12 represents yet another embodiment of the present invention, the apparatus of FIG. 12 being a modification of the FIG. 11 hardware. In the FIG. 12 embodiment the spout 24 is supported by a fork 156 which comprises a tubular body portion 158, supported for rotation in bearings 40, and a pair of branches between which the spout 24 is suspended, only a first branch 160 being visible in the drawing. Rotation of shaft 48, on which the control device 46 is mounted, about its axis is converted by means of a gear drive 164 to rotation of a shaft 162 which is coaxial with the body portion 158 of fork 156. The rotation of shaft 162, at a position located within the head of the furnace, is transformed back into pivotal motion by means of a pair of conical sector gears 166 and 168, gear 166 being affixed to shaft 162 and gear 168 being affixed directly to one of the suspension pivots of spout 24. Accordingly, rotation of shaft 48 about its axis is transformed into rotation of shaft 162 about axis X and the rotation of shaft 162 is converted into rotation of spout 24 about the axis Y of its suspension through the action of gears 166 and 168. A tilting or pivoting of shaft 48 about axis X is, in the manner described above, transmitted to the spout 24 by rotation of fork 156 and results in the axis of shaft 48 and suspension axis Y of the spout remaining in parallel.

In the previously described embodiments the suspension fork for the spout 24 was constructed in the form of a closed housing which completely surrounded the motion transmission mechanism which coupled the control device 24 to the spout. This form of hollow fork device is depicted in FIGS. 7 and 8. In the embodiment of FIG. 12 only the body portion 158 of the fork is of tubular construction and that portion of the motion transmission mechanism comprising the gears 166 and 168 are exposed to the furnace environment. Also, unlike the above described embodiments, in the FIG. 12 embodiment the movement of spout 24 about the suspension axis Y results from the application of force to only one side of the suspension.

With the exception of the above-discussed arrangement of FIG. 12, the suspension fork for spout 24 in accordance with the above-discussed embodiments of the present invention is in the form of a housing or enclosure with a motion transmission mechanism being located within this enclosure. Accordingly, particular attention must be directed to the technique for suspending the spout and imparting to it the movement of the motion transmission mechanism which is located within the suspension device, i.e., the enclosure defining suspension fork. A particularly useful means for suspending and transmitting motion to the spout will be described below in the discussion of FIGS. 13–16.

As may be seen from FIGS. 13 and 14, the spout 24 is provided with an outwardly extending flange 184 at its upper end. The spout is suspended, partly by means of this flange 184, in an annular cradle 180. Cradle 180 has an internal frusto-conical surface which accurately fits the contour of spout 24. Additionally, although not essential, a securing ring 182 may be provided at the base of cradle 180. The securing ring 182, if provided, will be received within a peripheral groove provided in the exterior of spout 24. Removal of spout 24 from cradle 180 may be achieved merely by disassembly and removal of ring 182 and thereafter causing the spout to move relative to the cradle in the upward direction as the apparatus is shown in FIGS. 13 and 14.

The cradle 180 is integral with an arm 186 which has in the general form of an inverted L. The lower end of the leg portion of L-shaped arm 186 is provided with an aperture which receives a pivot arm 188 of the branch 54 of connecting rod 50 (see FIG. 10). The connecting rod 50 will, of course, be situated within the arm 30 of a suspension fork 26 (see FIG. 8). The arm 186 is also provided, in its base portion, with a bore which receives a journal 190, arm 186 thus being freely rotatable about the journal 190 while being supported therefrom. The journal 190 forms part of the suspension fork and, in one embodiment, is provided on its internal surface with a flange 192 which forms a cover plate. This flange or cover 192 is welded or bolted over the aperture 62 in arm 30 of suspension fork 26 (see FIG. 8). The cover 192 also includes a removable auxiliary cover 194 through which access may be had to the joint between pivot 188 and arm 186, particularly for the purpose of installing and dismantling a securing ring on pivot 188.

It will be obvious that a device similar to that described above and shown in FIGS. 13 and 14 will be provided on the opposite side of the spout to secure and interconnect the cradle 180 to branch 28 of the suspension fork 26 and arm 52 of the connecting rod 50. Thus, the cradle 180, and consequently also the spout 24, is supported by a pair of journals 190 of the suspension fork 26 and the movements of the connecting rod 50 are converted by a pair of arms 186 into a pivoting movement of spout 24 about the axis Y defined by the journals 190.

In the interest of enabling cradle 180 and suspension fork 26 to be disassembled, a removable securing device is provided between cradle 180 and each of arms 186. This removable securing device is represented in FIGS. 13 and 14 as a bolt 196. The bolt or bolt 196 are, in the embodiment disclosed, coaxial with the journals 190 and secure cradle 180 to the base portion of arm 186 as shown. In order to insure the requisite rigidity, and to prevent relative rotation between the cradle and L-shaped arm, as may be seen from FIGS. 13*a* and 14*a*, the facing side surfaces of cradle 180 and arm 186 are provided with cooperating ridges or serrations as indicated at 198. Engagement of these ridges or serrations on the cradle and L-shaped arm insure that there will be no rotation of the arm relative to the cradle, or vice versa, and thus insure that movements of connecting rod 50 will be properly converted into a pivoting movement of spout 24 about axis Y rather than into friction between arms 186 and cradle 180. It is to be noted that bolts 196 are only accessible after the spout 24 has been released from cradle 180.

In accordance with a further characteristic of the preferred embodiment of the invention, means were provided for cooling and, if necessary or desirable, lubricating the suspension of spout 24 through the suspension fork. For this purpose, the connection between the suspension fork and the cradle 180 is rendered fluid tight by means of a sealing ring 200, or other suitable device which circumscribes the arms 186 where they pass through the walls of the branches 28 and 30 of the suspension fork 26. While a gas or liquid may be employed for cooling, a liquid coolant may additionally provide lubrication. For example, a mixture of water and an additive having lubricating, anti-corrosive and possibly anti-bacterial properties may be utilized. Such mixtures and additives are well known, the additives being currently employed in hydraulic fluids. The coolant/lubricant may, as schematically represented in FIG. 1, be supplied to the interior of the fork 26 through a coupling 202 which is integral with the body portion 44 of the fork. The coupling 202 will, of course, be a rotatable device which is hermetically mounted in a wall of the housing 32. The fluid supply may also include a rotary connection 208 which is connected to a supply conduit, and preferably a pair of supply conduits 204 and 206. As indicated schematically in FIG. 16, the coolant/lubricant circulates through a pair of conduits 210, 212 which extend from coupling 202 and which are situated along the outer walls of fork 26. These conduits penetrate the interior wall of the furnace by passing between the wall of the suspension fork and the bearing 40 in such a manner that they can follow the rotation of fork 80 about axis X. These conduits then extend into the branches 28 and 30 respectively of the suspension fork via borings 214 which are provided in each of the journals 190, the bores being coaxial with the suspension axis Y.

Figure 16:
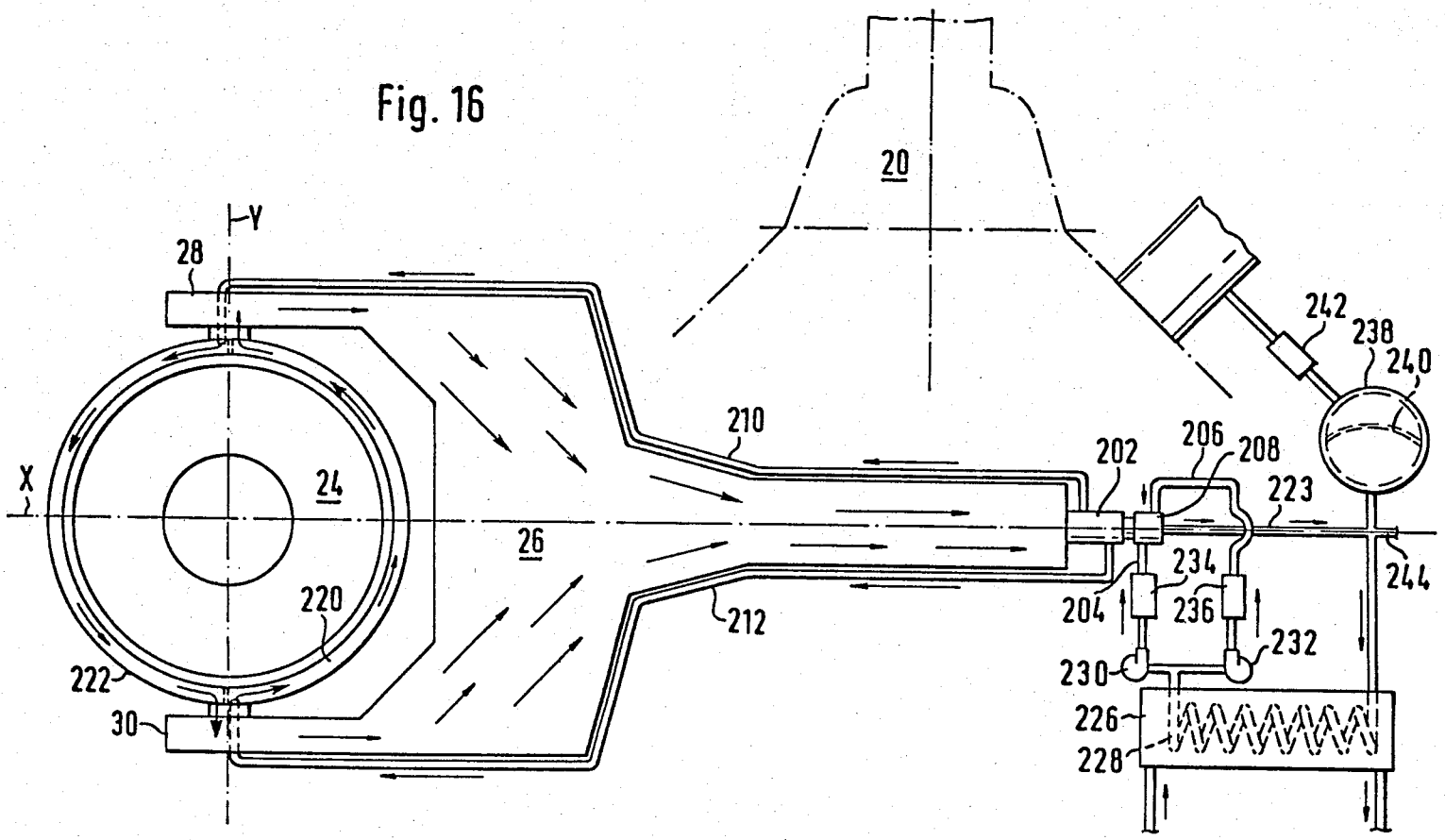
FIG. 16 is a schematic illustration of a distribution spout suspension cooling technique in accordance with the present invention.

Referring jointly to FIGS. 13–16, it may be seen that the cradle 180 is provided with two semi-cylindrical internal channels 220 and 222. These channels are separated from one another by means of partitions 224 (FIG. 15). Each of channels 220 and 222 is connected to the bore 214 of a respective journal 190 via a flow passage 216 which may best be seen from FIG. 13. The channels 220 and 222, as indicated in FIG. 16, direct the fluid flowing thereto around the cradle and, via discharge passages 218 (FIG. 14), back into the interior of the branches 28 and 30 of fork 26. The discharge passage 218, like the passage 216, is formed by holes provided in the cradle 180 and arm 186, these holes being in fluid communication as shown. The fluid which is circulated through the channels 220 and 222 thus fills the entire internal space of the suspension fork and is discharged therefrom through a passage in the interior of coupling 202. The coolant then passes through connection 208 which directs the fluid into an outlet conduit 224. There is, of course, a pair of supply passages 216 coupled to respective of the channels 220 and similarly a pair of the discharge passages 218. A supply passage and a discharge passage are situated side by side, as may be clearly seen from FIG. 15, on opposite sides of the partitions 224 which separate the channels 220 and 222.

Continuing to refer to FIG. 16, the circulation of the coolant/lubricant is represented by arrows in this schematic illustration. The cooling of cradle 180 and suspension fork 26 considerably reduces the deleterious affect of high temperature on the moving components of the spout suspension and control system and thus has a favorable affect on the service life of these components. Since the moving components, particularly those located within the fork 26, are completely immersed in the fluid, there are also lubricated thereby. In order to achieve the desired cooling, particularly if the system includes a closed coolant flow loop wherein the fluid is reused, a heat exchanger will be employed. As depicted in FIG. 16, the outlet pipe 224 may route the coolant through the coil 228 of a heat exchanger 226 and the cooled fluid is then returned to the supply conduits 210 and 212 by means of respective pumps 230 and 232. The discharge conduits from pumps 230 and 232, i.e., the conduits 204 and 206, may respectively be provided with filters 234 and 236. It is, of course, possible to employ a single coolant circulation pump.

It is also desirable to regulate the coolant pressure in accordance with the pressure prevailing within the furnace. Such regulation enables the elimination or minimization of the pressure differential across the various seals in the system thereby minimizing the risk of leakage and joint failure. For this purpose a pressure equalizing device 238 is provided for increasing or reducing the pressure of the cooling liquid in accordance with the pressure fluctuations taking place within the furnace. Such pressure equalization may, for example, be accomplished through the use of devices of the type well known in the art which employ a diaphragm 240. A first side of the diaphragm 240 in pressure equalizer 238 will, of course, be exposed to the furnace atmosphere via a filter 242. The other side of diaphragm 240 is exposed to the coolant at a point upstream of the heat exchanger 226. The branch conduit 244, which extends from discharge conduit 224 at a point upstream of the heat exchanger, will be connected to a reservoir and will serve to insure that the coolant flow circuit is always filled with fluid.

Figure 17:
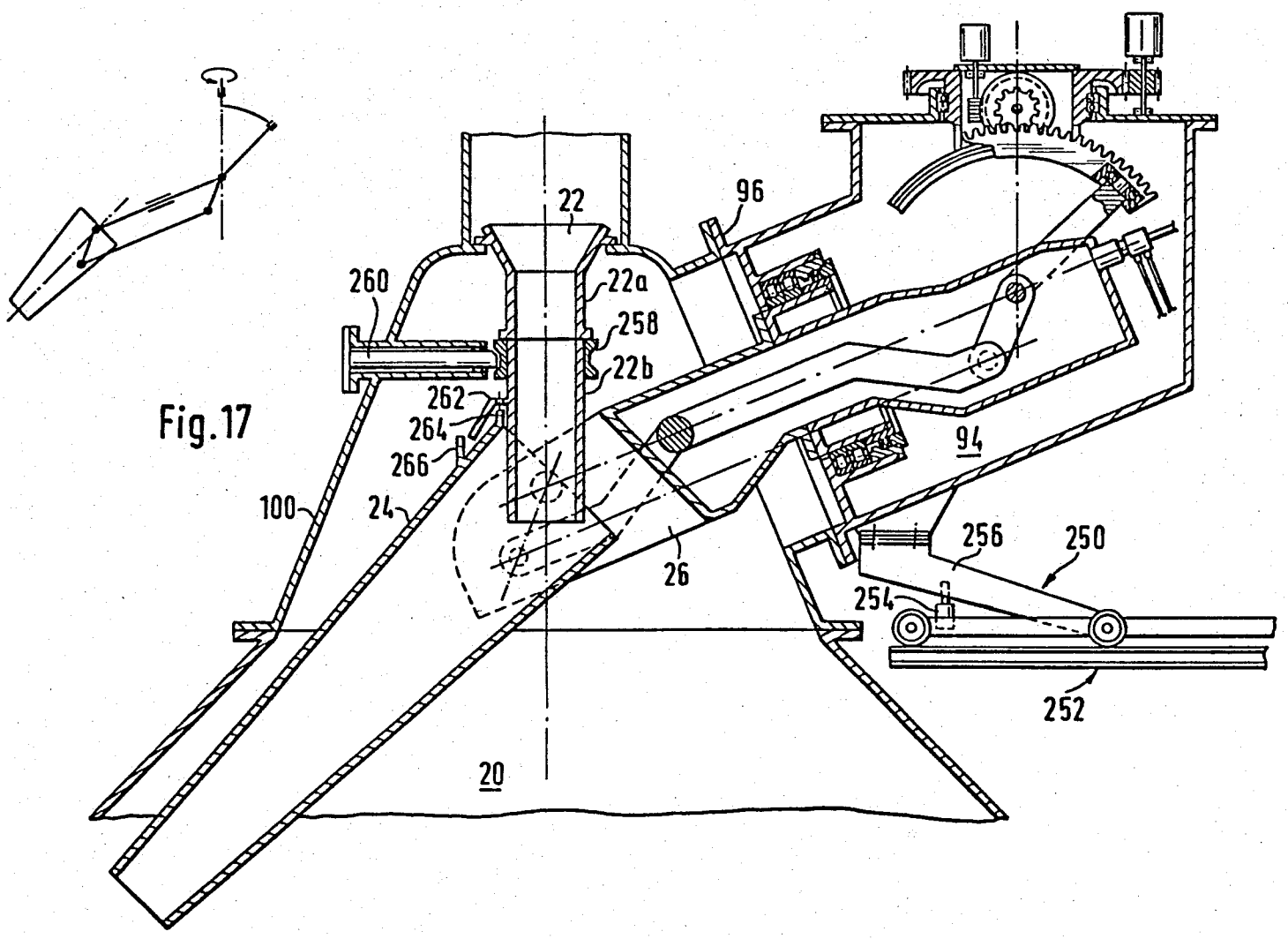
FIG. 17 is a schematic illustration which depicts the disassembly of the furnace charging installation of FIGS. 5 and 6.

As previously mentioned, an attribute of the present invention is that the spout 24 may be easily removed for servicing and subsequently reinstalled in the furnace throat. This is particularly true when the suspension fork as its axis inclined as shown in FIGS. 5 and 6. A technique for spout replacement will now be described by reference to FIGS. 17, 18 and 19. Since the assembly including the spout is quite heavy, a support carriage 250 which moves on a pair of rails 252 is provided. The support carriage has a lifting arm 256 which is actuated by a hydraulic jack 254. The lifting arm 250 may be rigidly coupled to the housing 94 and, of course, will be capable of supporting the combination of the housing, spout 24 and the drive mechanism for the spout after release of housing 94 from support flange 96 on the furnace carcass 100.

In accordance with the disclosed embodiment, the vertically oriented charge material supply channel 22 is comprised of an upper portion **22*a*, in the form of a funnel, and a cylindrical lower portion 22*b* which forms a prolongation of channel portion 22*a*. The upper portion 22*a* of the feed channel is designed to remain in place while the lower portion 22*b* of channel 22 is maintained in alignment with the upper portion 22*a* of the channel but is not physically connected thereto. The lower portion 22*b* of channel 22 may be removed by means of loosening a plurality of fasteners 260 which are evenly spaced about the channel 22 in the carcass 100 of furnace head 20. The fasteners 260 support the lower portion 22*b* of channel 22 by means of engaging a circular groove 258 which is provided about the upper periphery of channel portion 22*b*. A locking system, not shown is provided to insure that the fasteners 260 will not accidently become disengaged from the groove 258**.

The lower portion **22*b* of channel 22 also includes, intermediate its length, and outwardly extending hook device 262 which is provided with an aperture designed to be engaged by a lug 264 provided on the upper edge of spout 24. The hook device 260 is also designed such that it will engage, with a wedging action, a notch formed by welding a plate 266 on the exterior of spout 24**.

In order to dismantle the spout, the carriage 250 is moved in position beneath housing 94 on rails 252 and the lifting arm 256 is connected to a flange or projection provided on the exterior wall of housing 94 for engagement by arm 256. The bolts securing flange 96 are then released. This results in the combination of spout 24, housing 94 and all of the elements mounted in or supported on housing 94 being supported on carriage 250.

Figure 18:
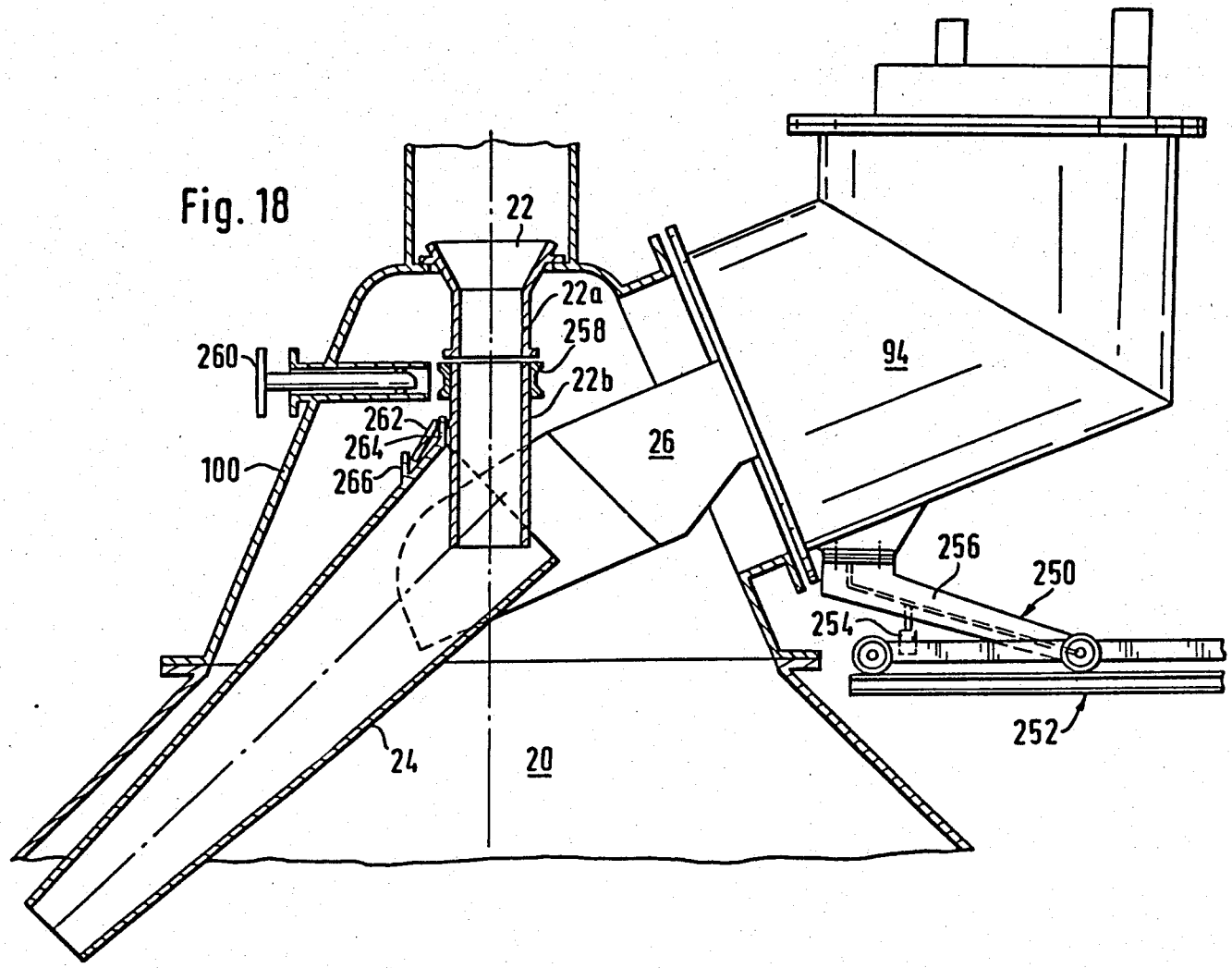
FIG. 18 is a view similar to FIG. 17 showing a further step in the dismantling procedure.
Figure 19:
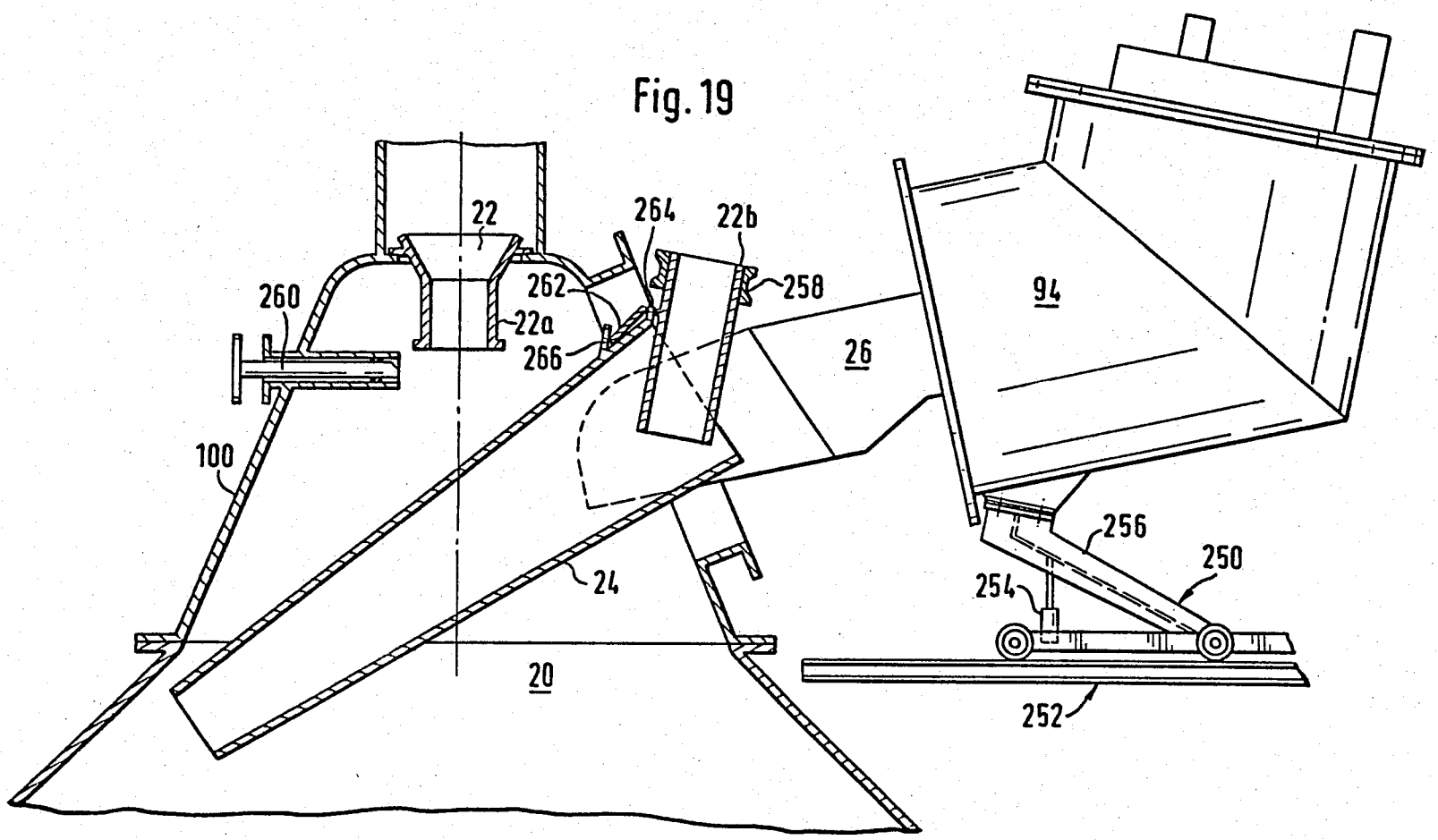
FIG. 19 is a view similar to FIG. 18 depicting yet a further step in the dismantling procedure.

Next, the arm 256 is raised slightly by means of the hydraulic jack 254 to cause lug 264 to penetrate the aperture in the hook device 262 which extends from the lower portion **22*b* of channel 22. This step is depicted in FIG. 18. With the lower portion of the channel thus supported by spout 24, the fasteners 216 may be released and withdrawn a sufficient distance so as to release the lower portion 22*b* of feed channel 22. Thereafter, as depicted in FIG. 19, the carriage 250 may be backed away from the furnace head in order to move the spout 24 and lower portion 22*b* of feed channel 22 in the direction of the aperture in carcass 100 defined by flange 96. During this disassembly procedure the lower portion 22*b* of the feed channel is supported in a stable position because of the wedging of the end of the hook device 262 in the notch defined by plate 266**. The reinstallation process will, of course, consist of the above described operations performed in the reverse order.

Figure 20:
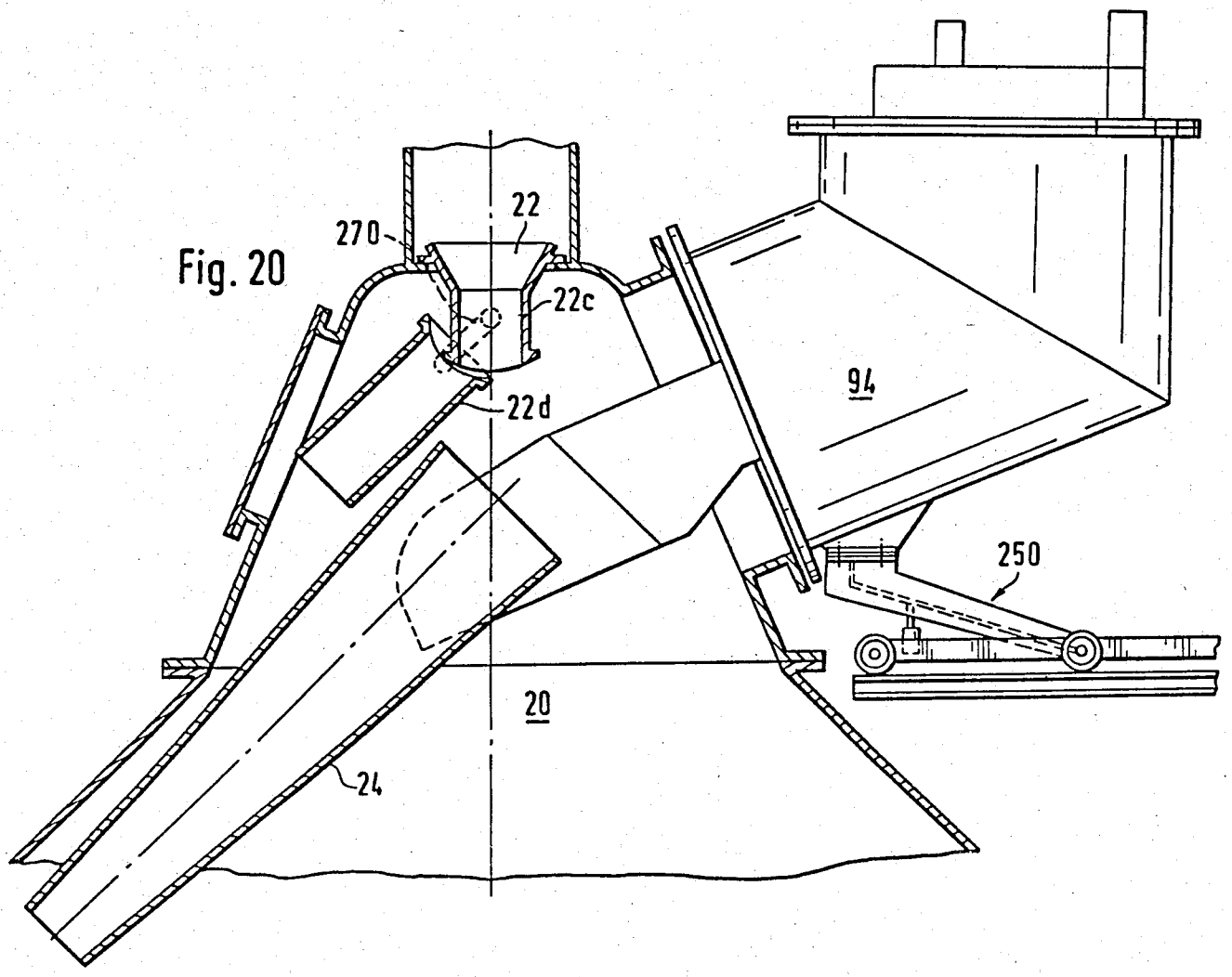
FIG. 20 comprises a schematic illustration of a second technique for removal of an oscillatory distribution spout from a furnace in accordance with the present invention.

FIG. 20 depicts a modified version of a system for dismantling and reinstalling spout 24. As shown in FIG. 20, the feed spout 22 is comprised of upper and lower portions respectively indicated at **22*c* and 22*d*. In the FIG. 20 embodiment, the lower portion 22*d* of the feed channel is suspended from a pivot arm 270 which penetrates the carcass 100 of furnace head 20. The pivot arm 270 may be actuated by suitable means, for example a motor, hydraulic jack or crank, from the exterior of the furnace in order to pivot the lower portion 22*d* of channel 22 to the position shown in FIG. 20. This, of course, would be accomplished with the spout 24 in a different orientation than that shown in FIG. 20. With the lower portion 22*d* of feed channel 22 pivoted to the side, the spout 24 may be released in the same manner as described above in the discussion of FIGS. 17–19 employing the support carriage 250**.

Figure 21:
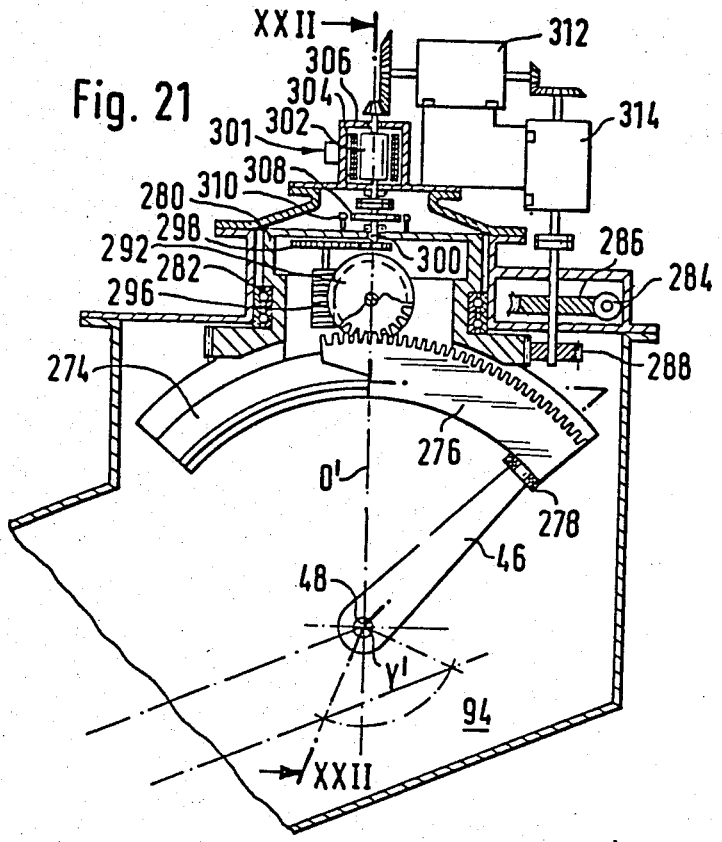
FIG. 21 is a schematic sectional side elevation view of a control device driving mechanism in accordance with the present invention and employing a pair of fixed position motors.
Figure 22:
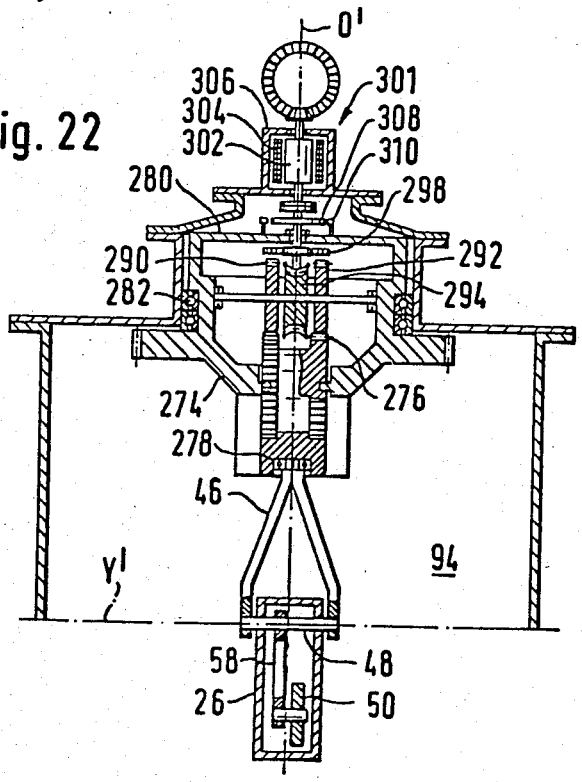
FIG. 22 is a view of the apparatus of FIG. 21 taken along line XXII—XXII of FIG. 21.

Referring now to FIGS. 21 and 22, a modification of the apparatus of FIG. 5 for imparting motion to the control device 46 is shown. The embodiment of FIGS. 21 and 22 includes a rotary cage 280 supported on housing 94 by means of bearings 282. A double guide bar 274 having the shape of a circular arch with its center of curvature situated on pivot axis Y′ of control device 46, is integral with the lower part of rotary cage 280. As in the previously described embodiment, a sector gear 276 slides between the two branches of the double guide bar 274. Sector gear 276 is connected to the end of control device 46 by a rotary connection 278 which converts the rotation of sector 276 about axis 0′ into a pivoting movement of the control device 46 about this same axis. The rotation of cage 280 about axis 0′ is produced by an endless screw 284 driven by a motor, not shown, which is coupled to cage 280 via a reduction gear system comprising a worm wheel 286 and a pinion 288.

The sector gear 276, as best seen from FIG. 22, is defined by a pair of parallel gear members which cooperate with pinions 290 and 292 to define a double rack and pinion arrangement supported on a rotary shaft mounted within cage 280 so as to be transverse to axis 0′. A worm wheel 294, mounted on the same shaft as pinions 290 and 292 and between the two pinions, is engaged by an endless screw 296. The screw 296, in turn, is driven by a pair of reducing pinions 298 and a shaft 300. Shaft 300 is coaxial with the axis 0′. The shaft 300 is connected directly to the rotor 302 of a motor which has been indicated generally at 301, the stator of motor 301 being indicated at 304 and the motor housing being indicated at 306. The housing or casing 306 of motor 301 is affixed to housing 94 in such a manner that the stator and rotor are coaxial with and concentric about axis 0′. Means, an electromagnetic brake for example, are provided for selectively connecting the rotor 302 of motor 301 to cage 280. As depicted in FIGS. 21 and 22, the electromagnetic brake comprises a disc 308, which is integral with the motor output shaft 300, and a number of shoes 310, connected to cage 280, which can selectively be caused to engage disc 308 in order to cause cage 280 to rotate with the rotor of motor 301.

Assuming that the spout is to be caused to rotate at a constant angle of inclination about the vertical axis of the furnace, i.e., the control device 46 is to be caused to perform a precession about the axis 0′ with a constant angle of inclination, the cage 280 is rotated by means of the endless screw 284 with motor 301 remaining deenergized. In this operational mode, the brake which provides the selective connection between rotating cage 280 and shaft 300 must be in the "on" condition. This will result in the combination formed by guide bar 274, sector gear 276, cage 280, the pinions mounted within cage 280, shaft 300 and rotor 302 of motor 301 rotating as a unit about axis O′ at a speed determined by the speed of rotation of endless screw 284. This angular velocity about axis O′ might, for example, be eight revolutions per minute.

If the angle of inclination of the spout relative to the vertical is to be altered without any rotation of the spout, i.e, the angle of inclination of control device 46 is to be modified, the cage 280 must remain stationery and the motor by which it is actuated must remain inoperative. In this mode of operation, the electromagnetic clutch system between cage 280 and rotor 302 of motor 301 is in the open or deenergized condition. Thus, when motor 301 is energized, the shaft 300, via the various gears described above, will cause the sector gear 276 to be driven whereupon the control device 46 will pivot about axis Y′.

The above described modes of operation, when performed alternately, will result in the discharge end of the charge distribution spout 24 transcribing concentric circles. It is also possible to modify the angle of inclination of the spout in the course of its rotation about the vertical axis O in order to cause the discharge end thereof to describe a path which is equivalent to a spiral. If a spiral trajectory for the falling charge material is desired, the motor which drives screw 284 and motor 301 will be energized simultaneously and, of course, the electromagnetic clutch must be in the deenergized state.

Continuing with the above discussion, when the two motors are simultaneously energized, the results produced by the rotation of the rotor of motor 301 will vary slightly as a function of the direction of rotation of the other motor or according to whether the spout is to be raised or lowered. Thus, when the cage 280 is rotating as a result of the energization of the first motor, the rotor 302 of motor 301 will rotate at the same speed which, in the above described example, will be eight revolutions per minute. These eight revolutions per minute are added to or subtracted from the speed, i.e., the number of revolutions per minute, of the rotor 302. Thus, there is a maximum difference of sixteen revolutions per minute according to the direction of rotation. However, since a typical operating speed for motor 301 is 1,500 revolutions per minute, this theoretical difference of sixteen revolutions per minute corresponds to about one (1%) percent and a one percent error in the trajectory of the fallen charge material may be disregarded.

It is, of course, necessary for the plant operator to know the exact angle of inclination of the charge distribution spout at any given moment. Thus, the apparatus may be provided with a device 312 for simulating and reproducing the tilting movement of the spout. The device 312 will detect the number of real revolutions performed by the rotor 302 of motor 301. Device 312 may, for example, consist of a miniaturized set of differential and planetary gears which provide an output shaft rotation to a monitoring and control device 314. The monitoring device 314 is also coupled to gear 286 and thus will also inform the operator of the instantaneous direction of the spout, knowledge of the direction and angle of inclination thus enabling the precise position of the discharge end of the spout to be known.

A principal advantage of the drive mechanism of FIGS. 21 and 22 when compared to the apparatus of FIG. 5 resides in the fact that the motor 301 is mounted on the axis O′ and may be fixed in position. This, of course, obviates the need to employ friction type contacts in order to transmit power to the motor as is the case of the motor 116 of FIG. 5 which is mounted in an eccentric position with respect to axis O′ and travels about this axis with a giratory motion.

Figure 23:
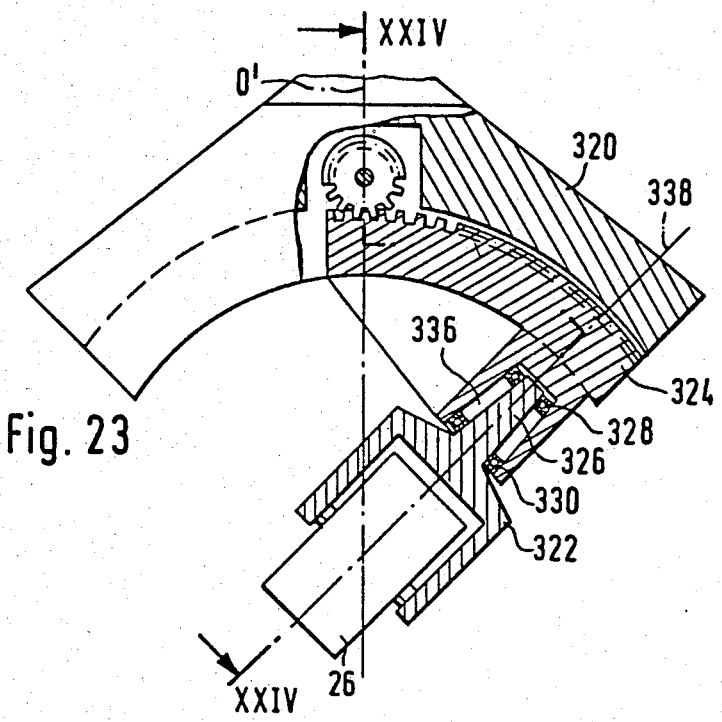
FIG. 23 is an enlarged view showing a rotary connection between a control device and a drive mechanism therefore in accordance with the present invention.
Figure 24:
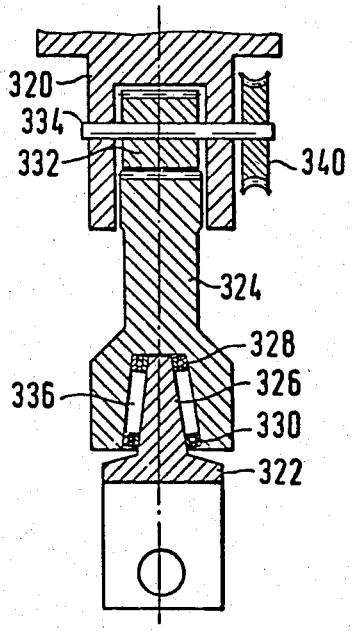
FIG. 24 is a sectional view taken along line XXIV—XXIV of FIG. 23.

FIGS. 23 and 24 illustrate an uncomplicated and efficient version of the connection between the driving mechanism and the control device which is applicable to all of the above described embodiments. In the apparatus of FIGS. 23 and 24 a guide bar 320, when viewed in cross section, has a U-shaped channel in which the sector 324 slides. Thus, guide bar 320 is, in the embodiment of FIGS. 23 and 24, merely a guide rail for the sector gear 324.

The control device, in the embodiment of FIGS. 23 and 24, is indicated at 322 and is in the form of a stirrup. The control device thus consists of a rod 326, in the shape of a truncated cone, which engages a pair of bearings 328 and 330 located within a bore formed in gear sector 324. The bearing 328 and 330 enable the control device 322 to rotate about the axis 338. No additional connection is required between control device 322 and gear sector 324, the bearings 328 and 330 being automatically maintained in place by the conical shape of the bore 336 in gear sector 324 and the conical shape of rod 326. The movement of the gear sector 324 within the channel defined by guide bar 320 is produced by means of a gear 332 (FIG. 24). The gear 332 is positioned within the U-shaped channel of guide bar 320 and mounted on a shaft 334. Gear 332 is driven by a worm wheel 340.

Figure 25:
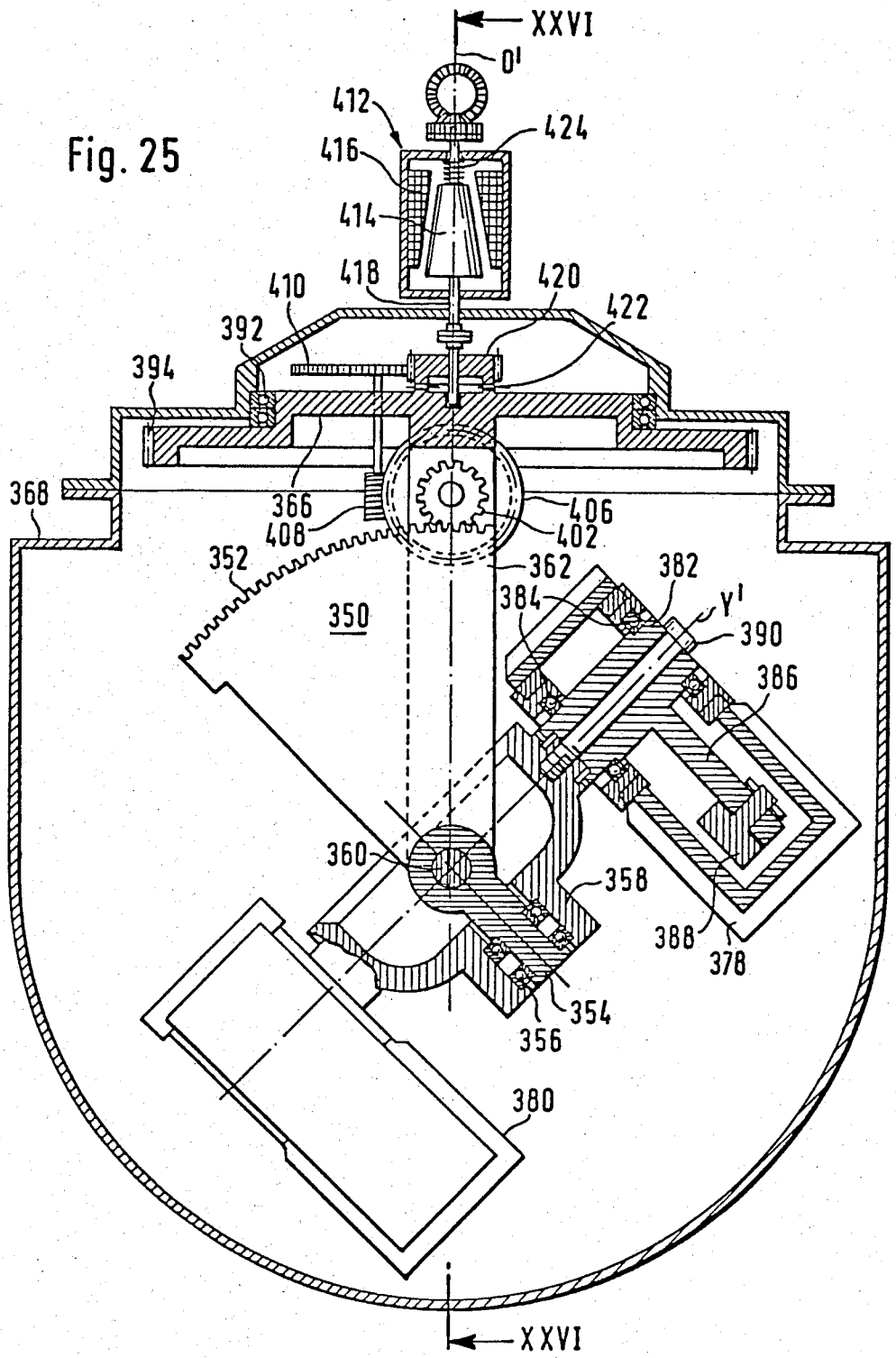
FIG. 25 is a schematic sectional view depicting another embodiment for actuating an oscillatory charge distribution spout in accordance with the present invention, FIG. 25 being a view taken in a plane perpendicular to the longitudinal axis of the suspension fork for the spout.
Figure 26:
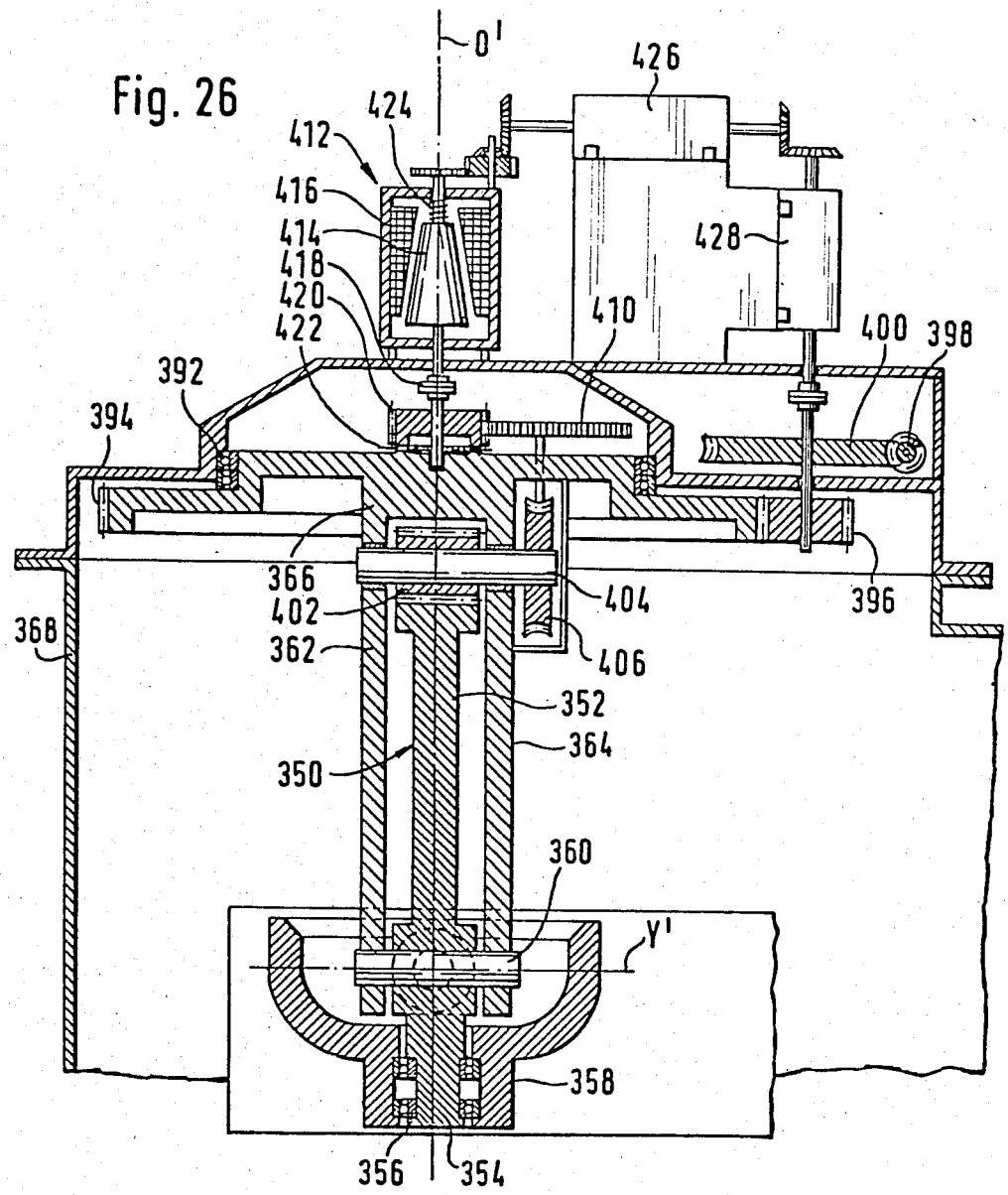
FIG. 26 is a view taken along line XXVI—XXVI of the apparatus of FIG. 25.
Figure 27:
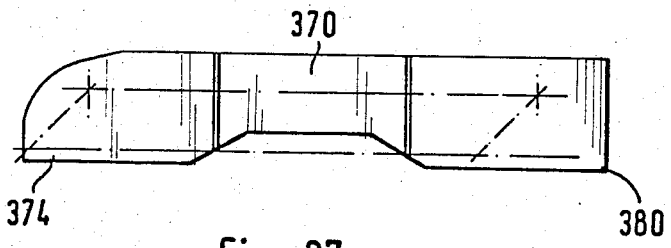
FIG. 27 is a side elevation view of a suspension fork for use with the apparatus of FIGS. 25 and 26.
Figure 28:
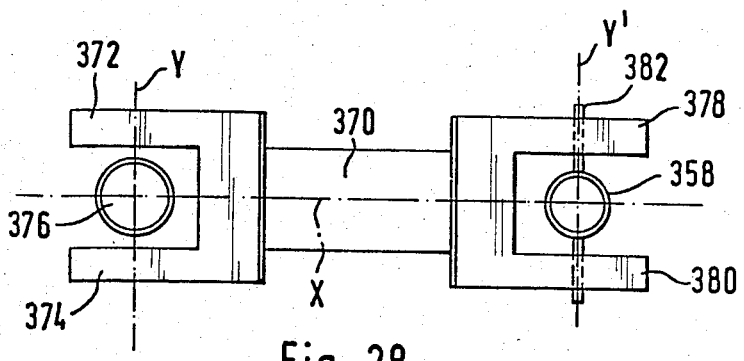
FIG. 28 is a plane view of the suspension fork of FIG. 27.

Another embodiment of a driving mechanism for a distribution spout in accordance with the present invention is shown in FIGS. 25 and 26. As in the above-described embodiments, operation of the embodiment of FIGS. 25 and 26 is predicated upon the causing of a control device, indicated at 350, to perform a precessional movement about an axis O′ which corresponds to the movement which the spout is required to perform in the furnace about the vertical axis of the furnace. In the embodiment of FIGS. 25 and 26 the control device 350 comprises a gear sector 352 which is capable of rotation about a shaft 360. As may best be seen from FIG. 26, shaft 360 is supported by means of a pair of brackets 362 and 364 which are integral with a rotary plate 366. The control device 350 also includes a rod 354. The longitudinal axis of rod 354 will be parallel to the longitudinal axis of the distribution spout. Rod 354 is mounted so that it may pivot in a base 358 on bearings 356. The bearing or bearings 356 correspond to the bearings 328 and 330 described above in the discussion of FIGS. 23 and 24 and enable relative rotational motion to occur between base 358 and rod 354. The control mechanism of FIGS. 25 and 26 will be employed with a spout suspension fork which preferably is constructed as a double fork. An example of such a double-ended suspension fork may be seen in FIGS. 27 and 28 where it is indicated generally at 370. The double-fork 370 comprises a pair of branches 372 and 374 between which the spout, indicated schematically at 376, is mounted. The double fork also comprises a second, oppositely disposed, pair of branches 378 and 380. The base 358 is mounted between branches 378 and 380. The mounting axis for base 358, indicated at Y′ and the axis Y of the pivot suspension for spout 376 are parallel. Thus, in the embodiment of FIGS. 25 and 26, the base 358 actually forms part of a shaft 382 (FIG. 28) which corresponds to the pivot shaft 48 for the control device which was described above in the discussion of FIG. 1.

The above mentioned shaft 382 passes through each of the branches 378 and 380 of fork 370. The bearings 384 enable shaft 382 to rotate about the axis Y′ and sealing means, not shown, enables a flow of cooling fluid to be established within fork 370. The pivoting movement of shaft 382 about axis Y′ is converted, by a lever 386 (FIG. 25), into a translational movement of a connecting rod 388 which is in the form of a double fork and operates inside the fork 370. The movement of the connecting rod 388 is transmitted to the spout as in the above-described embodiments to thereby cause the spout to pivot about axis Y.

In the interest of facilitating the dismantling operation, to enable repair work to be performed on the charge distribution spout, it is preferable to make the base 356 easily separable from shaft 382. For this purpose, a bolt 390 affixes shaft 382 to base 358, the axis of bolt 390 corresponding to the axis Y′. The abutting surfaces of base 358 and shaft 382 advantageously are provided with cooperating irregularities, circles of radial ridges as described above in the discussion of FIGS. 13*a* and 14*a* for example.

The design of branch 380 of fork 370 and its connection to base 358 is analagous to that of branch 378 and will not be described in detail.

The rotation of control device 350 about axis O′ is produced by imparting rotation to plate 366. Plate 366 is supported from a housing or frame 368 by means of bearing 392. Rotary plate 366 is provided with a peripheral toothed rim 398 which is engaged by a pinion 396. Pinion 396, in turn, is driven by a first motor, not shown, via an endless screw 398 and a worm wheel 400.

The sector gear 352 cooperates with a pinion 402 to define a rack and pinion drive mounted on shaft 404 which extends between the brackets 362 and 364. Shaft 404 is driven by a worm wheel 406 which, in turn, is driven by an endless screw 408. Screw 408 is coupled to a pinion 410 which is capable of rotating about its own axis and also moving with plate 366 about axis O'.

The pinion 410 is engaged by a second pinion 420 affixed to the output shaft 418 of a motor 412. The stator and rotor of motor 412 are indicated at 416 and 414 respectively. The motor 412, like the motor 301 of the embodiment of FIGS. 21 and 22, is mounted such that the axis of its rotor corresponds to the axis O'. The housing or frame of motor 412 is mounted so as to be integral with housing 368.

The apparatus of FIGS. 25 and 26 also includes a clutch mechanism which has been indicated schematically at 422. The clutch mechanism 422 is analogous to the clutch indicated by reference numerals 308 and 310 in FIGS. 21 and 22. The clutch mechanism 422 serves to selectively cause the rotor 414 of motor 412 to rotate with plate 366 or be independent of this plate. The output shaft 418 of motor 412, in order to permit the clutch to function properly, is movable in the axial direction and is subjected to the action of a spring 424 which biases the rotor 414 to the position shown in the drawing. Thus, the position of the elements of the apparatus as depicted in FIGS. 25 and 26 is commensurate with the clutch 422 being "closed" and rotor 414 of motor 412 thus being coupled to plate 366 for rotation therewith. The delivery of current to motor 412 will result in the generation of a magnetic field which will draw rotor 414 upwardly toward stator 416 against the action of spring 424. The upward movement of rotor 414 causes pinion 420 to also move upwardly whereupon the clutch 422 is opened and the coupling between plate 366 and rotor 414 is broken.

Referring to FIG. 26, reference numerals 426 and 428 respectively schematically represent a simulation and reproduction device for movements of the spout and a monitoring and control device. Thus, the elements 426 and 428 of FIG. 26 are respectively analogous to the elements 312 and 314 described above in the discussions of FIGS. 21 and 22.

The operation of the drive mechanism of FIGS. 25 and 26 is similar to that of the apparatus of FIGS. 21 and 22. Thus, to cause the distribution spout to rotate about the central axis O with a fixed and constant angle of inclination, the motor which drives the rotary plate 366 is energized and motor 412 is deenergized, the later action resulting in the clutch 422 being "closed" and the rotor 414 of motor 412 being coupled to plate 366 for rotation therewith. Assuming that the gear sector 352 occupies the position shown in FIG. 25, the rotation of plate 366 will cause rod 354 to perform a conical precession about axis O'. As a result of the rotary connection of rod 354 to base 358, and thus to branches 378 and 380 of fork 370, and also because of the action of the connecting rod 388 for movement inside fork 370, the spout will undergo movement which corresponds exactly to that of rod 354 with the angle of inclination of the spout with respect to the vertical axis of the furnace being identical to the axis of rod 354 with respect to axis O'.

A change in the angle of inclination of rod 354 with respect to axis O', and a corresponding change in the angle of inclination of the distribution spout, are achieved by energizing motor 412. The energization of motor 412 will have the effect of releasing the clutch system 422 in the manner described above whereupon rotation of rotor 414 of motor 412 will drive pinion 402 via the intermediate gears and thus the gear section 352 and control device 350 will be caused to move relative to axis O'.

As in the embodiment of FIGS. 21 and 22, the speed of rotation of the output shaft of motor 412 will vary depending upon the direction of rotation and in accordance with the speed of rotation of the motor which drives screw 398. However, for the reasons previously described, this variation in speed is sufficiently small so that it may be disregarded.

It is believed that it will be apparent to those skilled in the art that features of the several embodiments of the present invention described above may be combined. For example, it is possible to employ a control device similar to device 350 of FIGS. 25 and 26, with its particular connection to the spout suspension fork, in any of the other embodiments including the embodiment of FIG. 5 which utilizes an inclined suspension fork. It is, of course, also possible to adopt various combinations of the drive motor system for actuating the control device. Further, and by way of example, a motor system similar to that disclosed in U.S. Pat. No. 3,693,812 and 4,273,492 could be utilized to drive the control device. Thus, it is to be understood that the present invention has been described by way of illustration and not limitation.

What is claimed is:

1. In apparatus for use in the charging of a shaft furnace, the furnace being provided with an internally mounted steerable tubular member for guiding downwardly flowing charge material so as to cause the material to fall on the furnace hearth in accordance with a desired pattern, the tubular member defining a first longitudinal axis, the furnace also including a vertically oriented feed channel by which the charge material is delivered under the influence of gravity to the upper end of said steerable tubular member, an improved apparatus for steering the tubular member comprising:

suspension fork means for supporting the tubular member, said fork means being rotatably supported in a wall of said furnace, said fork means including an elongated body portion defining a second longitudinal axis, said fork means further including at least a first pair of parallel branches extending from one end of said body portion;

said suspension fork means being a hermetically sealed tubular housing adapted to allow cooling and lubricating fluid the flow throughout the interior of said tubular housing and thereby cool and lubricate any moving components located therein;

means for pivotally mounting the tubular member adjacent a first end thereof between said branches of said suspension fork means, said mounting means defining a third axis about which the tubular member may pivot, said third axis being transverse to the first longitudinal axis of the tubular member;

control means, said control means being positioned exterior of the enclosure, said control means defining a fourth longitudinal axis;

pivot means, said pivot means including a rotatable shaft which is engaged by said control means adjacent a first end of said control means, said pivot means shaft defining a fifth axis which is transverse to said fourth axis;

means for imparting motion to said control means at a point displaced from said pivot means to cause said fourth longitudinal axis of said control means to undergo a pattern of movement which it is desired to have the first longitudinal axis of the tubular member follow;

motion transmission means for coupling rotational motion of said control means fourth axis about said pivot means shaft defined fifth axis to the tubular member to thereby cause the tubular member to rotate about said third axis, said motion transmission means being enclosed within said body portion and said parallel branches of said fork means; and means connecting said pivot means to said fork means whereby rotation of said control means fourth axis about a point of intersection of said fourth and fifth axes is converted into rotation of said fork means about said second longitudinal axis and simultaneous rotation of the tubular member with said means for pivotally mounting the tubular member.

2. The apparatus of claim 1 wherein a portion of said suspension fork means, said control means, said pivot means, said means for imparting motion to said control means and at least a part of said motion transmission means are positioned within a housing mounted on the exterior of the furnace, said housing covering an opening in the side of the furnace, said suspension fork means extending into the furnace through a wall of said housing and said opening in the furnace.

3. The apparatus of claim 2 further comprising:

means for pressurizing said housing to a pressure at least as high as that existing within the furnace.

4. The apparatus of claim 3 wherein the furnace has a vertical axis and said first and third axes intersect at said vertical axis and wherein said suspension fork means second longitudinal axis intersects said furnace vertical axis at said point of intersection of said first and third axes, the intersection of said second and furnace vertical axes being at an angle other than 90°.

5. The apparatus of claim 2 wherein said housing is removable supported on the furnace exterior and wherein said apparatus further comprises:

movable support means, said support means being adjustable so as to engage and support said housing whereby said steering apparatus may be removed from the furnace as a unit.

6. The apparatus of claim 1 wherein the furnace has a vertical axis and wherein the vertically oriented feed channel comprises:

an upper portion, said feed channel upper portion receiving charge material delivered to the furnace and directing said charge material downwardly, said upper portion of said feed channel being coaxial with the furnace vertical axis; and a lower feed channel portion, said lower portion being normally aligned with said upper portion, said lower portion being removable from the furnace with said steering apparatus.

7. The apparatus of claim 6 further comprising:

releasable support means for said feed channel means lower portion, said releasable support means being operated from the exterior of the furnace.

8. The apparatus of claim 7 wherein the said feed channel lower portion and said tubular member are provided with cooperating engagement means whereby, upon operation of said releasable support means to the released position, said lower portion of said feed channel will be engaged by and supported on said tubular member.

9. The apparatus of claim 8 wherein said releasable support means comprises:

means defining a circular groove extending about the periphery of said feed channel lower portion; and a plurality of support arms, said support arms engaging said circular groove at spaced locations to support said feed channel lower portion, said arms extending through the furnace wall and being movable radially inwardly and outwardly with respect to the furnace axis to selectively release or engage said circular groove.

10. The apparatus of claim 1 wherein said apparatus further comprises;

means for establishing a flow of cooling fluid through said suspension fork means.

11. The apparatus of claim 1 wherein the tubular member is of frustoconical shape and wherein said means for pivotally mounting the tubular member between branches of said suspension fork means comprises:

an annular cradle, said cradle having an opening therein which is complementary in shape to the exterior shape of the tubular member, said tubular member being supported in said cradle; and means for pivotally supporting said cradle from said fork means first pair of parallel branches.

12. The apparatus of claim 11 wherein said motion transmission means includes:

at least a first L-shaped lever positioned within one of said fork means branches, a first arm of said L-shaped lever extending outwardly through a wall of a branch of said fork means;

means establishing a rigid connection between the end of said first arm of said L-shaped lever and said cradle:

connecting rod means extending through said fork means; and means establishing an articulated connection between the end of said L-shaped lever second arm and said connecting rod means.

13. The apparatus of claim 12 further comprising:

means defining a socket in said L-shaped lever; and journal means for supporting said L-shaped lever, said journal means extending from an inner wall of said fork means branch, said journal means being received in said socket.

14. The apparatus of claim 13 wherein said cradle is at least partly of hollow construction and wherein said apparatus further comprises:

first conduit means for delivering the cooling fluid to the interior of said cradle, said conduit means including at least a first pair of cooperating passages extending through said journal and lever; and second conduit means defined by said cradle and a passage in said arm means for returning cooling fluid from the interior of said cradle to the interior of said fork means to establish a flow of cooling fluid through said fork means.

15. The apparatus of claim 10 wherein said cradle is at least partly of hollow construction and wherein said cooling flow establishing means comprises:

first conduit means for delivering a coolant to the interior of said cradle; and second conduit means for returning coolant from said cradle to the interior of said fork means.

16. The apparatus of claim 1 wherein said means for imparting motion to said control means comprises:

guide means for defining an arcuate motion path, said guide means defining an arc of a circle, the radius of curvature of said circular arc being equal to the distance from said guide means to the intersection of said fourth and fifth axes, the center of curvature of said guide means defined arc comprising said point of intersection;

first gear means movably mounted on said guide means, said first gear means having the same curvature as said guide means;

means establishing a rotary connection between said first gear means and said control means;

first drive means for rotating said guide means and said first gear means about a sixth axis, said sixth axis being parallel to a central axis about which the second end of the tubular member may be caused to rotate, said central axis intersecting said first, second and third axes; and second drive means for causing said first gear means to move relative to said guide means to thereby cause said control means to pivot about said fifth axis to thereby vary the angle of inclination of said fourth axis with respect to said sixth axis.

17. The apparatus of claim 16 wherein the tubular member is of frustoconical shape and wherein said means for pivotally mounting the tubular member between branches of said suspension fork means comprises:

an annular cradle, said cradle having an opening therein which is complementary in shape to the exterior shape of the tubular member, said tubular member being supported in said cradle; and means for pivotally supporting said cradle from said fork means first pair of parallel branches.

18. The apparatus of claim 5 wherein the furnace has a vertical axis and wherein the vertically oriented feed channel comprises:

an upper portion, said feed channel upper portion receiving charge material delivered to the furnace and directing said charge material downwardly, said upper portion of said feed channel being coaxial with the furnace vertical axis; and a lower feed channel portion, said lower portion being normally aligned with said upper portion, said lower portion being removable from the furnace with said steering apparatus.

19. The apparatus of claim 18 further comprising:

releasable support means for said feed channel means lower portion, said releasable support means being operated from the exterior of the furnace.

20. The apparatus of claim 19 wherein the said feed channel lower portion and said tubular member are provided with cooperating engagement means thereby, upon operation of said releasable support means to the released position, said lower portion of said feed channel will be engaged by and supported on said tubular member.

21. The apparatus of claim 20 wherein said releasable support means comprises:

means defining a circular groove extending about the periphery of said feed channel lower portion; and a plurality of support arms, said support arms engaging said circular groove at spaced locations to support said feed channel lower portion, said arms extending through the furnace wall and being movable radially inwardly and outwardly with respect to the furnace axis to selectively release or engage said circular groove.

* * * * *